US008270863B2

(12) United States Patent
Okano

(10) Patent No.: US 8,270,863 B2
(45) Date of Patent: Sep. 18, 2012

(54) IMAGE FORMING APPARATUS THAT DETECTS THE STATE OF THE CASING OF THE IMAGE FORMING APPARATUS

(75) Inventor: Tetsuya Okano, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 486 days.

(21) Appl. No.: 12/508,192

(22) Filed: Jul. 23, 2009

(65) Prior Publication Data

US 2010/0021202 A1 Jan. 28, 2010

(30) Foreign Application Priority Data

Jul. 25, 2008 (JP) ..... 2008-192728

(51) Int. Cl.
*G03G 15/00* (2006.01)

(52) U.S. Cl. ..... 399/71

(58) Field of Classification Search ..... 399/90, 399/71

See application file for complete search history.

(56) References Cited

U.S. PATENT DOCUMENTS

| | | | | |
|---|---|---|---|---|
| 4,540,269 | A * | 9/1985 | Nishiyama | 340/689 |
| 5,016,049 | A * | 5/1991 | Onishi et al. | 399/32 |
| 5,105,218 | A | 4/1992 | Ikeda et al. | |

FOREIGN PATENT DOCUMENTS

| | | | |
|---|---|---|---|
| EP | 1246027 | A2 | 10/2002 |
| JP | H05-336315 | A | 12/1993 |
| JP | H10-026922 | A | 1/1998 |
| JP | H10-049003 | A | 2/1998 |
| JP | H10-107929 | A | 4/1998 |
| JP | H10-221790 | A | 8/1998 |
| JP | H11-153938 | A | 6/1999 |
| JP | 2001-194961 | A | 7/2001 |
| JP | 2001-309114 | A | 11/2001 |
| JP | 2002-185715 | A | 6/2002 |
| JP | 2004-133259 | A | 4/2004 |
| JP | 2004-302006 | A | 10/2004 |
| JP | 2005-249830 | A | 9/2005 |
| JP | 2005-305895 | A | 11/2005 |
| JP | 2006-163192 | A | 6/2006 |
| JP | 2007-028185 | A | 2/2007 |
| JP | 2008-137256 | A | 6/2008 |

OTHER PUBLICATIONS

Japan Patent Office, Notification of Reason for Refusal for Patent Application No. JP2008-192728, dated Jul. 15, 2010. Japan Patent Office; Notification of Reason for Refusal for Patent Application No. 2008-192728, dispatched Jan. 18, 2011.

European Patent Office, extended European Search Report for European Patent Application No. 09166199.1 (counterpart to above-captioned patent application), dated Apr. 26, 2012.

* cited by examiner

*Primary Examiner* — David Gray
*Assistant Examiner* — Andrew Do
(74) *Attorney, Agent, or Firm* — Baker Botts L.L.P.

(57) ABSTRACT

An image forming apparatus includes an image forming unit configured to perform printing and an initializing process, a casing formed with an opening and accommodating the image forming unit, a cover configured to open and close the opening, a detecting unit configured to detect whether the cover is in an opened state or a closed state, a measuring unit configured to measure an opening degree of the cover in the opened state, and a controller configured to control an initializing process of the image forming unit according to the opening degree of the cover in the opened state, when the detecting unit detects that the cover is changed from the closed state to the open state and that the cover is returned to the closed state.

9 Claims, 15 Drawing Sheets

IMAGE FORMING APPARATUS THAT DETECTS THE STATE OF THE CASING OF THE IMAGE FORMING APPARATUS

CROSS-REFERENCE TO RELATED APPLICATION

This application claims priority from Japanese Patent Application No. 2008-192728, filed on Jul. 25, 2008, the entire subject matter of which is incorporated herein by reference.

TECHNICAL FIELD

Aspects of the present invention relate to an image forming apparatus.

BACKGROUND

A known multi-function peripheral apparatus (image forming apparatus) includes a sensor which detects the opening and closing of a cover and performs a print preparation operation, such as rotating a photosensitive drum when it is determined that the cover is closed.

The image forming apparatus performs a print preparation operation whenever the cover is closed. When the cover is closed, other processes is performed in addition to the print preparation operation. For example, an image forming apparatus determines that, when a cover is closed, a maintenance operation is likely to be performed during the cover being opened and performs an initializing process corresponding to the maintenance operation. Specifically, for example, an image forming apparatus determines that, when a cover is closed, a developing cartridge is likely to be replaced during the cover being opened and performs an old and new developing cartridge identifying process.

However, even when the cover is opened, the maintenance operation is not necessarily performed. Therefore, according to the above-described configuration in which the initializing process is performed whenever the cover is closed, when the maintenance operation is not performed, the initializing process is not useful.

SUMMARY

Accordingly, it is an aspect of the present invention to provide an image forming apparatus which reduces or prevents performing a useless initializing process.

According to an exemplary embodiment of the present invention, there is provided an image forming apparatus comprising: a casing formed with an opening and including a cover configured to open and close the opening; an image forming unit configured to perform printing on a recording medium and an initializing process; a detecting unit configured to detect whether the cover is in an open state or a closed state; a measuring unit configured to measure an opening degree of the cover; and a controller coupled to the detecting unit and the measuring unit. When the detecting unit detects that the state of the cover is changed from the closed state to the open state and returned to the closed state, the controller controls the image forming unit, based on the opening degree of the cover within a first open time period during which the detecting unit detects that the cover is in the open state, to perform the initializing process upon the detecting unit detecting the cover returned to the closed state, if the opening degree of the cover is equal to or greater than a threshold value within the first open time period, and not to perform the initializing process upon the detecting unit detecting the cover returned to the closed state, if the opening degree of the cover is less than the threshold value within the first open time period.

According to another exemplary embodiment of the present invention, there is provided an image forming apparatus comprising: a casing including a door; an image forming unit operable in a first mode and a second mode; a detecting unit configured to detect a state of the door from among a closed state in which the door is closed, a first open state in which the door is opened and an opening degree of the door is less than a threshold value, and a second open state in which the door is opened and the opening degree of the door is equal to or greater than the threshold value; and a controller coupled to the image forming unit and the detecting unit. The controller controls the image forming unit, if the state of the door is changed from the closed state to the first opened state and returned to the closed state without being in the second opened state, to operate in the first mode upon the door returned to the closed state, and if the state of the door is changed from the closed state to the second open state through the first open state, and thereafter, returned to the closed state through the first open state, to operate in the second mode, and thereafter, switch to the first mode upon the door returned to the closed state.

According to another exemplary embodiment of the present invention, there is provided an image forming apparatus comprising: an image forming unit configured to form an image on a recording medium; a casing formed with an opening and accommodating the image forming unit; a cover configured to open and close the opening; a detecting unit configured to detect a state change of the cover between an open state and a closed state; a measuring unit configured to measure an opening degree of the cover in the opened state; and a controller configured to control, when the detecting unit detects a state change of the cover from the closed state to the open state and returning to the closed state, an initializing process of the image forming unit according to the opening degree of the cover in the open state.

According to the above-described configuration, it is possible to reduce or prevent performing a useless initializing process.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

Exemplary embodiments of the present invention will be described with reference to FIGS. 1 to 16.

(1) Overall Configuration of Printer

Figure 1:
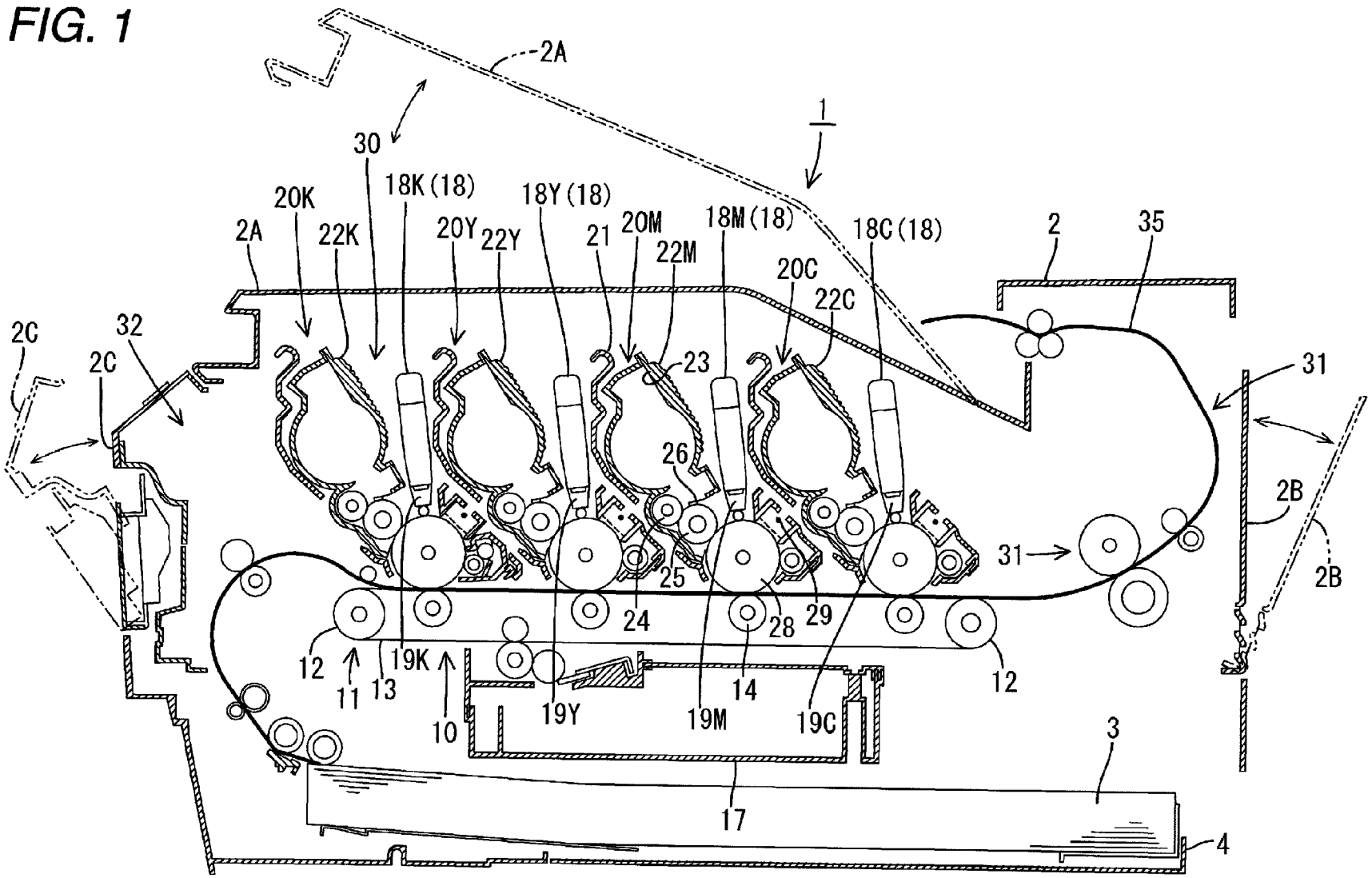
FIG. 1 is a cross-sectional view schematically illustrating the structure of an image forming apparatus according to an exemplary embodiment of the present invention.

FIG. 1 is a cross-sectional view schematically illustrating the structure of a printer 1 (an example of an image forming apparatus) according to an exemplary embodiment of the present invention. In this exemplary embodiment, the printer 1 is a color printer which uses four color toners (black, yellow, magenta, and cyan) to form a color image. In the following description, when components are discriminated by colors, K (black), Y (yellow), M (magenta), and C (cyan) are added to the ends of reference numerals indicating the components. In addition, in the following description, the left side of FIG. 1 is taken as the front side of the printer, and the right side of FIG. 1 is taken as the rear side thereof.

A casing 2 has a substantially box shape, and accommodates, for example, an image forming unit 10. The casing 2 is formed with an opening 30 at an upper surface thereof, for various maintenance operations of the image forming unit 10, such as the insertion or removal of developing cartridges 22K, 22Y, 22M, and 22C and the removal of paper (an example of a recording medium) jam (hereinafter, referred to as a "jam"). A cover (door) 2A is rotatably connected to the casing 2, and opens the opening 30 (open state) and closes the opening 30 (closed state).

Further, the casing 2 is formed with openings 31 and 32 at a front and rear surfaces thereof, respectively. The openings 31 and 32 are mainly used to remove a jam, and covers (doors) 2B and 2C for opening and closing the openings 31 and 32 are provided in the front and rear surfaces, respectively.

A sheet feed tray 4 is provided at a lower part of the casing 2 such that the sheet feed tray 4 can be drawn out forward from the casing 2. Sheets 3 accommodated in the sheet feed tray 4 are fed one by one onto a transport path 35 by various rollers (an example of a transport unit) and a belt unit 11 (an example of the transport unit).

The image forming unit 10 includes, for example, the belt unit 11, transfer rollers 14, a cleaning unit 17, an exposure unit 18, a processing unit 20, and a fixing unit 31.

The belt unit 11 includes a pair of front and rear belt supporting rollers 12 and a transport belt 13 wound around the belt supporting rollers 12. The transport belt 13 is rotated in the clockwise direction in FIG. 1 by the belt supporting rollers 12 to transport the sheet backward.

Four transfer rollers 14 are provided so as to oppose corresponding photosensitive drums 28 with the transport belt 13 interposed therebetween.

The cleaning unit 17 is provided below the belt unit 11, and cleans the transport belt 13 by, for example, collecting toner or paper powder adhered to the surface of the transport belt 13.

The exposure unit 18 includes four LED units 18K, 18Y, 18M, and 18C respectively corresponding to black, yellow, magenta, and cyan. These LED units are supported at the lower surface of the cover 2A by a supporting unit (not shown), and have LED heads 19K, 19Y, 19M, and 19C at the lower ends thereof. Each of the LED heads includes a plurality of LEDs arranged linearly in a direction vertical to the plane of the paper.

The processing unit 20 includes four process cartridges 20K, 20Y, 20M, and 20C corresponding to the four colors. When the cover 2A is opened, the LED units 18K, 18Y, 18M, and 18C are retreated together with the cover 2A such that the process cartridges 20K, 20Y, 20M, and 20C can be inserted and removed.

The process cartridges 20K, 20Y, 20M, and 20C include cartridge frames 21 and developing cartridges 22K, 22Y, 22M, and 22C that are removably mounted to the cartridge frames 21.

The photosensitive drum 28 and a scorotron charging unit 29 which can be inserted into and removed from the cartridge frame 21 are provided in the cartridge frame 21.

The developing cartridges 22K, 22Y, 22M, and 22C accommodate therein color toners as developers. Toner discharged from a toner chamber 23 is supplied to a developing roller 25 by the rotation of a supply roller 24, and the supplied toner is carried on the developing roller 25 as a thin layer with a uniform thickness by a layer thickness regulating blade 26. The developing cartridges 22K, 22Y, 22M and 22C each include a toner sensor (not shown) which detects the remaining amount of toner.

The fixing unit 31 thermally fixes to the sheet the toner image transferred onto the sheet.

(2) Outline of Printing Operation

The photosensitive drum 28 is uniformly charged in a positive potential by the charging unit 29, and then exposed to light emitted from the exposure unit 18 according to image data to be printed. Accordingly, an electrostatic latent image is formed on the surface of the photosensitive drum 28. The electrostatic latent image formed on the surface of the photosensitive drum 28 is developed into each color toner image by toner supplied by the developing roller 25.

Then, when the sheet transported by the transport belt 13 passes through transfer positions between the photosensitive drums 28 and the transfer roller 14, the toner images on the surface of the photosensitive drums 28 are sequentially transferred onto the sheet by a negative transfer bias applied to the transfer roller 14.

The fixing unit 31 thermally fixes to the sheet the toner images transferred to the sheet, and the sheet having the toner images thermally fixed thereto is discharged to the upper surface of the cover 2A.

(3) Electrical Configuration of Printer

Figure 2:
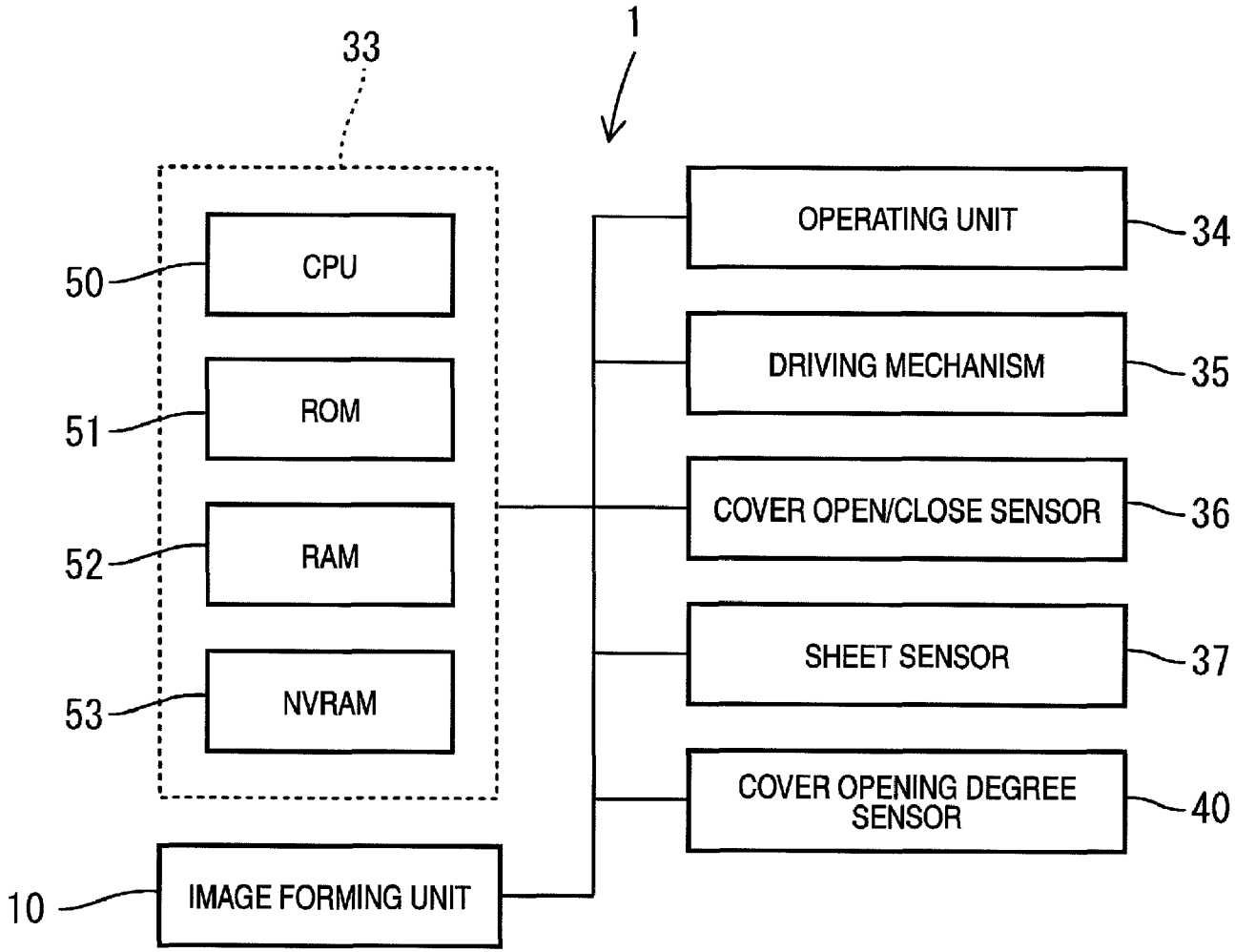
FIG. 2 is a diagram schematically illustrating the electrical configuration of the image forming apparatus according to an exemplary embodiment of the present invention.

FIG. 2 is a diagram schematically illustrating the electrical configuration of the printer 1. The printer 1 includes, for example, a control unit 33, the image forming unit 10, an operating unit 34, a driving mechanism 35, cover open/close sensors 36, sheet sensors 37, and a cover opening degree sensor 40.

The control unit 33 includes, for example, a CPU 50 (an example of an image forming unit, a detecting unit, a measuring unit, a controller, a timer, and a transport unit), a ROM 51, a RAM 52, and an NVRAM 53. The ROM 51 stores a program for performing, for example, an initializing process, which will be described later The CPU 50 performs the program read from the ROM 51 to control each unit of the printer 1.

The operating unit 34 includes operating buttons which allow the user to input various settings or instructions and a liquid crystal display for displaying various information items.

The driving mechanism 35 (an example of the image forming unit) includes, for example, a motor and a gear train which transmits the rotational force of the motor to the developing roller 25 and the photosensitive drums 28. Further, the driving mechanism 35 includes a rotating shaft which is moved forward or backward relative to the photosensitive drums 28. When the opening degree of the cover 2A is equal to greater than a threshold value, the rotating shaft is retreated to be disengaged from the photosensitive drums 28, such that the photosensitive drums 28 can be inserted and removed. When the cover 2A is closed, the rotating shaft is moved toward the photosensitive drums 28 such that the rotating shaft is engaged with the photosensitive drums 28.

Figure 3:
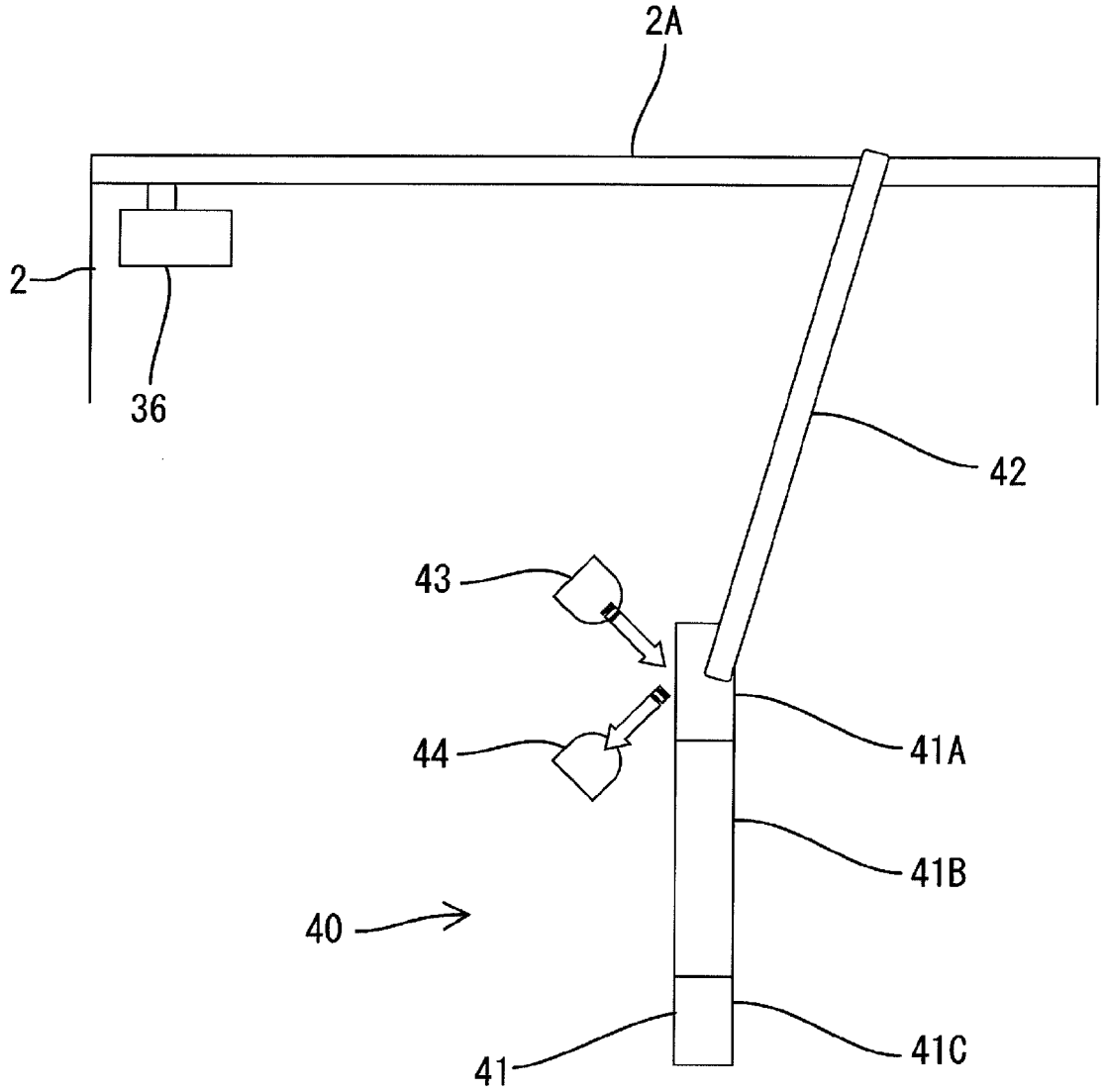
FIG. 3 is a diagram schematically illustrating a cover opening degree sensor according to the embodiment of the invention.
Figure 4:
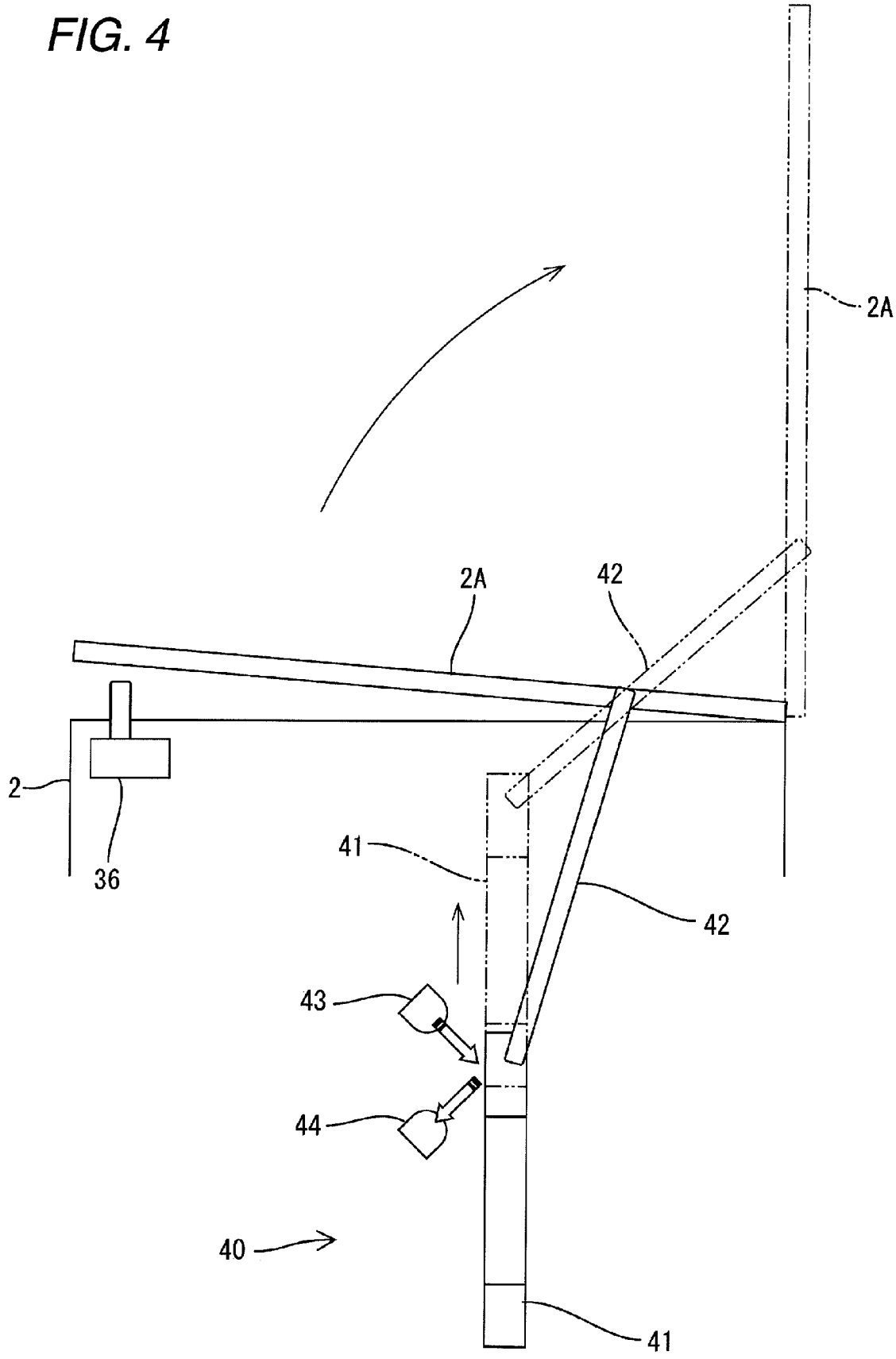
FIG. 4 is a diagram schematically illustrating the cover opening degree sensor according to an exemplary embodiment of the present invention.

The cover open/close sensor 36 (an example of the detecting unit) is provided in each of the covers 2A, 2B, and 2C. As shown in FIGS. 3 and 4, a switch which is turned on when the cover is opened and is turned off when the cover is closed may be used as the cover open/close sensor 36.

A plurality of sheet sensors 37 (an example of a sensor which detects a recording medium) are provided along the transport path 35. For example, an optical sensor may be used as the sheet sensor 37.

The cover opening degree sensor 40 (an example of the determining unit) is provided in each of the covers 2A, 2B, and 2C, and detects the opening degree of each of the covers 2A, 2B and 2C.

FIGS. 3 and 4 are diagrams schematically illustrating an example of the cover opening degree sensor 40 which detects the opening degree of the cover 2A. The cover opening degree sensor 40 includes, for example, a moving member 41 which is provided so as to be movable in the vertical direction, a connecting member 42 which converts the rotation motion of the cover 2A into the vertical motion of the moving member 41, a light source 43 which emits light to the surface of the moving member 41, and an optical sensor 44 which receives light reflected from the surface of the moving member 41 and outputs a detection signal corresponding to the intensity of the received light, to the CPU 50.

As shown in FIG. 3, the surface of the moving member 41 is divided into three regions, that is, an upper part 41A, a middle part 41B, and a lower part 41C in the vertical direction, and the regions have different reflectances. For example, the upper part 41A is black, the middle part 41B is gray, and the lower part 41C is white. An opening degree corresponding to the boundary between the upper part 41A and the middle part 41B, and an opening degree corresponding to the boundary between the middle part 41B and the lower part 41C are also refer to as a threshold value. That is, in this exemplary embodiment, two threshold values are set. The threshold value may be set to a value corresponding to the opening degree of the cover 2A at which the opening 30 is opened by an amount greater than the developing cartridge 22 to be replaceable.

(4) Initializing Process of Image Forming Device

In this exemplary embodiment, an initializing process performed when the cover 2A is closed include a transport belt cleaning process, an old and new developing cartridge identifying process, a remaining toner amount detecting process, a photosensitive drum counter clear process, a transport belt counter clear process, a rotating shaft pre-rotating process, and a color shift correcting process. Hereinafter, each of the processes will be described.

The transport belt cleaning process uses the cleaning unit 17 to clean the transport belt 13. For example, when the cover 2A is opened, dust may enter the printer through the opening and then may be adhered to the transport belt 13, or when the cover 2A is opened and the developing cartridge 22 is inserted or removed, toner may drop and then may be adhered to the transport belt 13. In this case, when the cover 2A is closed, the printer 1 rotates the transport belt 13 to perform the cleaning process, thereby removing the adhered dust or toner.

The old and new developing cartridge identifying process determines whether the developing cartridge 22 is a new one. The developing roller 25 deteriorates with use term. Therefore, when the printer 1 counts the number of rotations of the developing roller 25 and it is found that the number of rotations is greater than a threshold value, the printer notifies the user to replace the developing cartridge 22. When the user is notified of the replacement of the developing cartridge 22, the user opens the cover 2A to replace the developing cartridge 22. When the cover 2A is closed, the printer 1 determines whether the developing cartridge 22 is a new one. When it is determined that the developing cartridge 22 is a new one, the printer clears a counter that counts the number of rotations of the developing roller 25. When the counter is cleared, the counter is set to zero.

The remaining toner amount detecting process detects the remaining amount of toner in the developing cartridge 22. When the cover 2A is opened, the user is likely to replace the developing cartridge 22. In this case, the user may replace with a developing cartridge 22 having no remaining toner. When the developing cartridge having no toner, the printer 1 cannot print an image. Therefore, when the cover 2A is closed, the printer 1 detects the remaining amount of toner in the developing cartridge 22.

The photosensitive drum counter clear process clears a counter (photosensitive drum counter) which counts the number of rotations of the photosensitive drum 28. The photosensitive drum 28 becomes not easily charged or the photosensitive drum 28 deteriorates due to scratches with long-term use. Therefore, when the printer 1 counts the number of rotations of the photosensitive drum 28 and it is found that the number of rotations is greater than a threshold value, the printer notifies the user to replace the photosensitive drum 28. When the user is notified of the replacement of the photosensitive drum, the user opens the cover 2A to replace the photosensitive drum 28. After replacing the photosensitive drum 28, the user operates the operating unit 34 to notify the printer 1 that the photosensitive drum 28 has been replaced. When the cover 2A is closed, the printer 1 determines whether the replacement of the photosensitive drum 28 is notified. When it is determined that the replacement of the photosensitive drum 28 is notified, the printer clears the photosensitive drum counter.

The transport belt counter clear process clears a counter (transport belt counter) which counts the number of rotations of the transport belt 13. The transport belt 13 deteriorates due to expansion, scratches, or cracks with long-term use. Therefore, when the printer 1 counts the number of rotations of the transport belt 13 and it is found that the number of rotations is greater than a threshold value, the printer notifies the user to replace the transport belt 13. The flow of a process of clearing the transport belt counter is substantially same as that of the process of clearing the counter of the photosensitive drum 28, and thus a description thereof will be omitted.

The rotating shaft pre-rotating process rotates the rotating shaft before the transport belt 13 is rotated. As described above, when the opening degree of the cover 2A is equal to or greater than a threshold value, the rotating shaft is retreated and disengaged from the photosensitive drum 28. In this case, the user is likely to insert or remove the photosensitive drum 28, or the user is likely to touch the photosensitive drum 28 to rotate without inserting or removing the photosensitive drum 28. When the photosensitive drum 28 is inserted or removed, or when the photosensitive drum 28 is rotated, the rotating shaft is moved forward. In this case, the photosensitive drum 28 is not directly engaged with the rotating shaft, but the rotation of the photosensitive drum 28 is temporarily delayed due to idling until the photosensitive drum 28 is engaged with the rotating shaft, when the transport belt 13 is rotated. When the rotation of the photosensitive drum 28 is delayed, the photosensitive drum 28 is likely to be damaged by friction with the transport belt 13. Therefore, in this exemplary embodiment, before the transport belt 13 is rotated, the rotating shaft is rotated to engage the photosensitive drum 28 with the rotating shaft. In this way, it is possible to reduce idling, and thus reduce the difference between the time when the transport belt 13 starts to rotate and the time when the photosensitive drum 28 starts to rotate.

The color shift correcting process corrects color shift caused by the positional deviation of the LED unit 18 due to the opening or closing of the cover 2A. As described above, since the LED unit 18 is supported by the cover 2A, the position of the LED unit 18 is likely to slightly deviate from its original position due to vibration when the cover 2A is closed or opened. When the positional deviation of the LED unit 18 occurs, each color image forming position on the sheet deviates from its original position, which results in color shift. Therefore, the printer 1 performs the color shift correcting process when the cover 2A is closed. For example, as a method of correcting the color shift, the following methods are known, which includes: printing a predetermined correcting pattern on the transport belt 13, detecting the printed correcting pattern using an optical sensor to calculate a correction amount, and shifting an exposure timing based on the calculated correction amount to correct color shift in a sub-scanning direction, or shifting the range of an LED used for exposure to correct color shift in a main scanning direction.

(5) Operation of Printer

Figure 5:
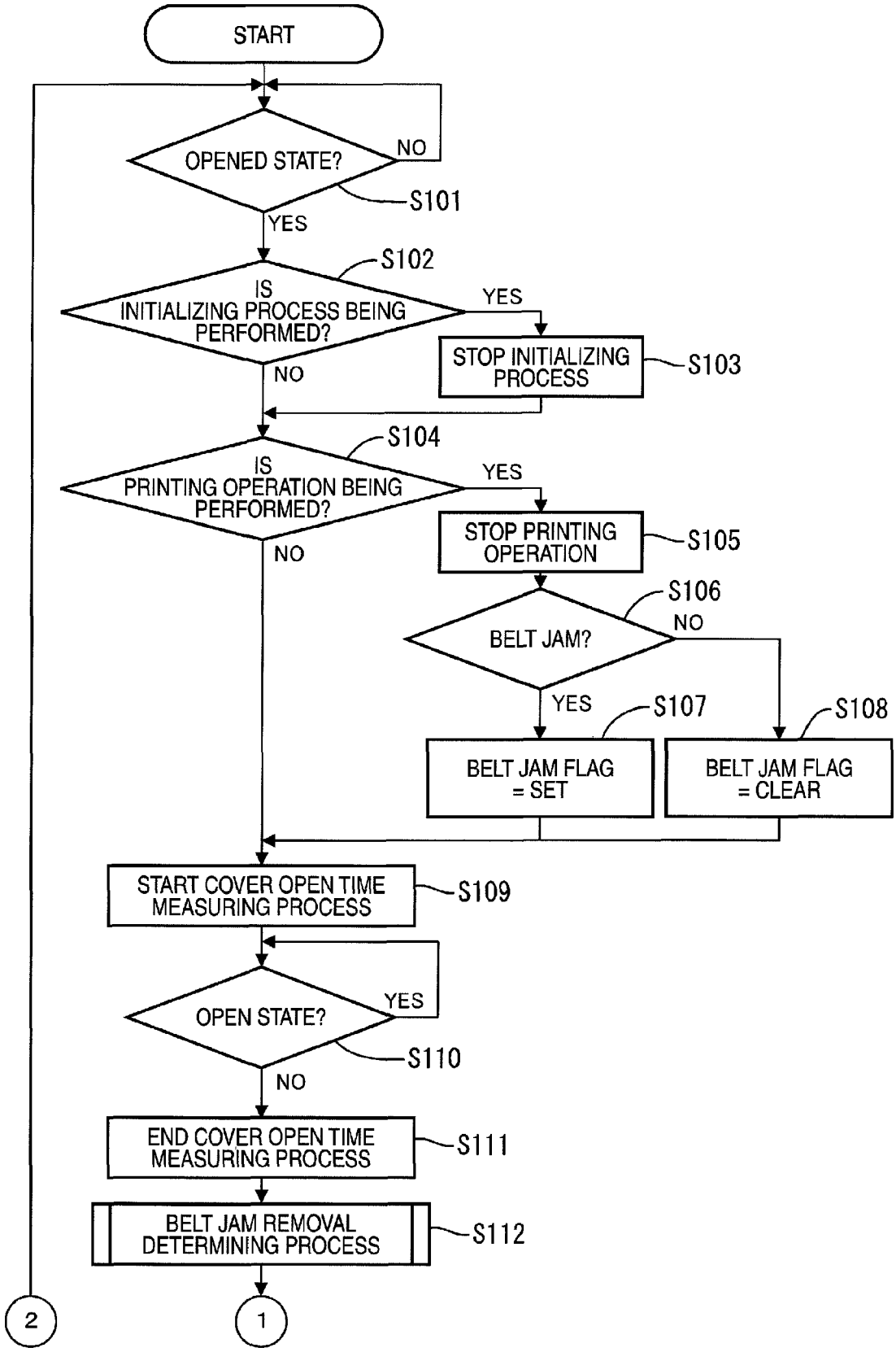
FIG. 5 is a flowchart illustrating an initializing process according to an exemplary embodiment of the present invention.
Figure 6:
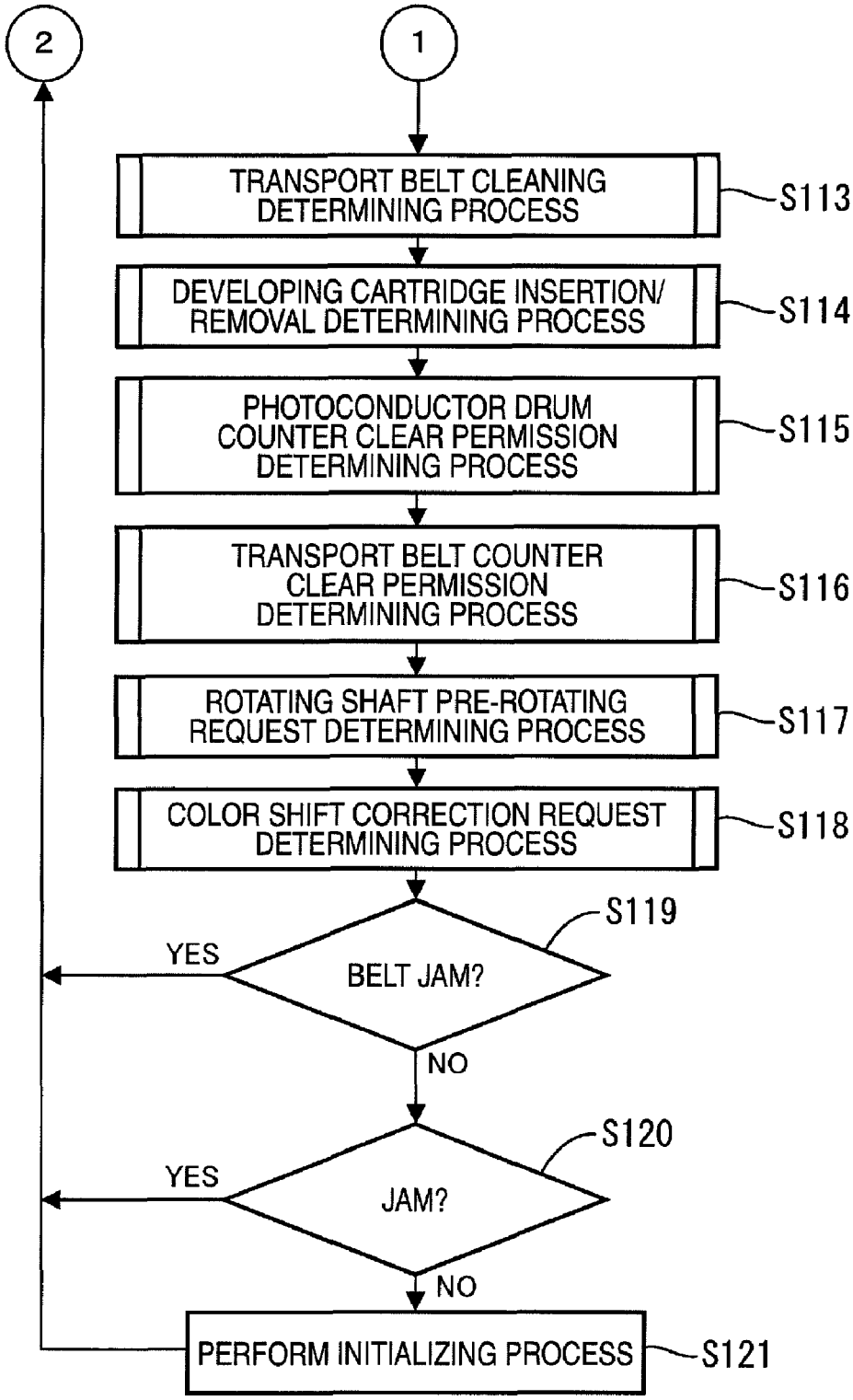
FIG. 6 is a flowchart illustrating the initializing process.

FIGS. 5 and 6 are flowcharts illustrating a process of detecting the opening and closing of the cover to perform the initializing process. Here, the cover 2A is described as an example.

In Step S101, the CPU 50 monitors the sensor output of the cover open/close sensor 36 to detect whether the cover 2A is opened or closed. When the cover 2A is not in an open state, that is, when it is in a closed state, the CPU 50 determines whether the cover 2A is opened or closed again after a predetermined time has elapsed. When the cover 2A is in the open state, the process proceeds to Step S102.

In Step S102, the CPU 50 determines whether the printer 1 is performing the initializing process. During the initializing process, it is dangerous for the user to put a hand into the casing 2 since the casing 2 has high-temperature or high-pressure parts or parts which are mechanically operated. Therefore, the CPU 50 determines whether the printer 1 is performing the initializing process, and then, when it is determined that the printer 1 is performing the initializing process, the CPU 50 proceeds to Step S103 to stop the initializing process. When it is determined that the printer 1 is not performing the initializing process, the CPU 50 proceeds to Step S104.

In Step S104, the CPU 50 determines whether the printer 1 is performing a printing operation. During the printing operation, it is dangerous for the user to put a hand into the casing 2 since the casing 2 has high-temperature or high-pressure parts or parts that are mechanically operated. Therefore, the CPU 50 determines whether the printer 1 is performing the printing operation. When it is determined that the printer 1 is performing the printing operation, the CPU 50 proceeds to Step S105 to stop the printing operation, and proceeds to Step S106. When it is determined that the printer 1 is not performing the printing operation, the CPU 50 proceeds to Step S109.

In Step S106, the CPU 50 determines whether a belt jam occurs. One cause of the opening of the cover 2A during the printing operation is a jam. The jam occurs when a sheet is caught in the detection range of any one of the sheet sensors 37 and when a sheet is caught between two sheet sensors 37. In this exemplary embodiment, the case in which a sheet is caught between two adjacent sheet sensors 37 arranged on the upstream and downstream sides with the transport belt 13 interposed therebetween is referred to as a belt jam.

When the sheet is caught in the detection range of any one of the sheet sensors 37, it is possible to determine whether a jam occurs and whether the jam is removed, based no the sensor output. In contrast, in the case of a belt jam, it is possible to determine whether a belt jam occurs based on a sensor output, but it may be difficult to determine whether the belt jam is removed based on the sensor output. Specifically, the belt jam means the state in which the upstream sheet sensor 37 detects a sheet but the downstream sheet sensor 37 does not detect the sheet. Therefore, it is possible to determine whether a belt jam occurs based on the sensor outputs of the two sheet sensors 37 before the cover 2A is opened. In contrast, the sensor output does not vary regardless of whether the belt jam is removed or not. Therefore, it is difficult to determine whether the belt jam is removed based on the sensor output.

Therefore, in this exemplary embodiment, whether the belt jam is removed is estimated based on opening the degree of the cover 2A and the cover open time period of the cover 2A in an open state. Specifically, the opening degree of the cover 2A needs to be greater than a predetermined value in order to remove the belt jam. Therefore, when the opening degree of the cover 2A is equal to or greater than a threshold value, it is estimated that the belt jam is removed. However, even though the opening degree is equal to or greater than the threshold value, the belt jam may not be removed if the cover open time period is short. Therefore, the printer 1 estimates that the belt jam is removed when the time period for which the opening degree of the cover 2A is equal to or greater than a threshold value, is longer than a threshold time period.

In this exemplary embodiment, first, it is determined whether a belt jam occurs based on the sensor outputs of the two sheet sensors 37 before the cover 2A is opened. When it is determined that the belt jam occurs, the CPU 50 proceeds to Step S107. When it is determined that the belt jam does not occur, the CPU 50 proceeds to Step S108.

In Step S107, the CPU 50 sets a value indicating that a belt jam occurred to a variable of a "belt jam flag" indicating whether the belt jam occurs, and then the CPU 50 proceeds to Step S109. In Step S108, the CPU 50 clears the "belt jam flag". When the "belt jam flag" is cleared, the CPU 50 sets a value indicating that no belt jam occurs to the "belt jam flag", and then the CPU 50 proceeds to Step S109.

In Step S109, the CPU 50 starts a cover open time measuring process of measuring the time period for which the opening degree of the cover 2A is equal to or greater than a threshold value, and then, the CPU 50 proceeds to Step S110. The cover open time measuring process starts as a task different from the main process, and is performed in parallel to the main process until the cover 2A is closed. The cover open time measuring process will be described in detail later.

In Step S110, the CPU 50 determines whether the cover 2A is in an open state. When it is determined that the cover 2A is in the open state, the CPU 50 performs the determination again after a predetermined time has elapsed. When it is determined that the cover 2A is not in the open state, that is, the cover 2A is in a closed state, the CPU 50 proceeds to Step S111.

In Step S111, the CPU 50 ends the cover open time measuring process and proceeds to Step S112. In Step S112, the CPU 50 performs a belt jam removal determining process of determining whether a belt jam is removed. When the transport belt 13 is driven in a belt jam state, the belt jam becomes worse. Therefore, as described above, the CPU 50 estimates whether the belt jam is removed based on the degree of opening and the cover open time period of the cover 2A in an open state (in Step S110). The belt jam removal determining process will be described in detail later. After Step S112, the CPU 50 proceeds to Step S113

In Step S113, the CPU 50 performs a transport belt cleaning determining process of determining whether to perform the transport belt cleaning process. When dust or toner is not adhered to the transport belt 13, the transport belt cleaning process is not useful. When the opening degree of the cover 2A is small, dust is less likely to enter the printer, and dust is less likely to be adhered to the transport belt 13. It is noted that the opening degree of the cover 2A needs to be greater than a threshold value in order to insert or remove the developing cartridge 22. Therefore, when the opening degree of the cover 2A in an open state is small, the developing cartridge 22 is less likely to be inserted or removed, and toner is less likely to be adhered to the transport belt 13. Even though the opening degree is large, the developing cartridge is less likely to be inserted or removed if the cover open time period is short. Therefore, toner is less likely to be adhered to the transport belt. Therefore, the CPU 50 determines whether to perform the transport belt cleaning process based on the opening degree and the cover open time period of the cover 2A in an open state. The transport belt cleaning determining process will be described in detail later. After Step S113, the CPU 50 proceeds to Step S114.

In Step S114, the CPU 50 performs a developing cartridge insertion/removal determining process of determining whether the developing cartridge 22 is inserted or removed. When the developing cartridge 22 is not inserted or removed, the old and new developing cartridge identifying process or the remaining toner amount detecting process are not useful. As described above, when the opening degree is small, or when the opening degree is large but the cover open time period is short, the developing cartridge 22 is less likely to be inserted or removed. Therefore, the CPU 50 determines whether the developing cartridge 22 is inserted or removed, that is, whether to perform the old and new developing cartridge identifying process and the remaining toner amount detecting process, based on the opening degree and the cover open time period of the cover in the open state. The developing cartridge insertion/removal determining process will be described in detail later. After Step S114, the CPU 50 proceeds to Step S15.

In Step S115, the CPU 50 performs a photosensitive drum counter clear permission determining process of determining whether to permit the photosensitive drum counter clear process. It can be considered that the replacement of the photosensitive drum 28 is notified by an erroneous operation even though the photosensitive drum 28 is not replaced. Even when the replacement of the photosensitive drum is notified by an erroneous operation, the photosensitive drum counter is cleared. In this case, even though the number of rotations of the photosensitive drum 28 is greater than a value required for replacement, the photosensitive drum 28 is continuously used. It is noted that the opening degree of the cover 2A needs to be greater than a threshold value in order to replace the photosensitive drum 28. Therefore, when the replacement of the photosensitive drum 28 is notified even though the opening degree of the cover 2A is small, the replacement notice is more likely to be issued by an erroneous operation. In addition, even though the opening degree is large, the replacement notice is more likely to be issued by an erroneous operation if the cover open time period is short. Therefore, the CPU 50 determines whether to permit the photosensitive drum counter clear process based on the opening degree g and the cover open time period of the cover 2A in the open state. The photosensitive drum counter clear determining process will be described in detail later. After Step S115, the CPU 50 proceeds to Step S116.

In Step S116, the CPU 50 performs a transport belt counter clear permission determining process of determining whether to perform the transport belt counter clear process. Similarly, it can be considered that the replacement of the transport belt 13 is notified by an erroneous operation. Therefore, the CPU 50 determines whether to permit the transport belt counter clear process based on the opening degree and the cover open time period of the cover 2A in the open state, for the same reason as that in the photosensitive drum counter clear process. The transport belt counter clear determining process will be described in detail later. After Step S116, the CPU 50 proceeds to Step 117.

In Step S117, the CPU 50 performs a rotating shaft prerotating request determining process of determining whether to request the rotation of the rotating shaft before the transport belt 13 is rotated. When the rotating shaft is retreated but the time required to retreat the rotating shaft is short, the photosensitive drum 28 is less likely to be inserted or removed, or rotated. If the photosensitive drum 28 is not inserted or removed, or if it is not rotated, the rotating shaft is engaged with the photosensitive drum 28 by the forward movement of the rotating shaft. Even when the rotating shaft is engaged with the photosensitive drum 28, the photosensitive drum 28 is damaged if the rotating shaft is rotated before the transport belt is rotated. Therefore, the CPU 50 determines whether to request the rotation of the rotating shaft before the transport belt 13 is rotated based on the cover open time period. The rotating shaft pre-rotating request determining process will be described in detail later. After Step S117, the CPU proceeds to Step S118.

In Step S118, the CPU 50 performs a color shift correction request determining process of determining whether to request a color shift correcting process. When the opening degree of the cover 2A is small, it is less likely that the position of the LED head 19 will deviate from its original position, and a color shift is less likely to occur. Therefore, when the opening degree of the cover 2A is small, the color shift correcting process is not useful. Therefore, the CPU 50 determines whether to perform the color shift correcting process based on the opening degree of the cover 2A in the open state. The color shift correcting process will be described in detail later. After Step S118, the CPU proceeds to Step S119.

In Step S119, the CPU 50 determines whether the "belt jam flag" is set. When the "belt jam flag" is set, there is a high probability that the belt jam is not removed. Therefore, when the transport belt 13 is driven in this state, the belt jam becomes worse. When the "belt jam flag" is set, the CPU 50 returns to Step S101 without performing the initializing process. On the other hand, when the "belt jam flag" is not set, the CPU 50 determines that the belt jam has been removed and proceeds to Step S120.

In Step S120, the CPU 50 determines whether the sheet sensor 37 detects a sheet. When the sheet is detected, the CPU 50 determines that the jam is not removed, and returns to Step S101 without performing the initializing process. On the other hand, when the sheet is not detected, the CPU 50 determines that the jam has been removed and proceeds to Step S121.

In Step S121, the CPU 50 performs the initializing process determined to be performed in Steps S112 to S118. When it is determined to perform the initializing process in Steps S112 to S118, a value indicating "execution", a value indicating "permission", or a value indicating "request" is set to a flag corresponding to the initializing process. The CPU 50 performs only the initializing process in which these values are set to the flags. That is, the CPU 50 restricts the execution of the initializing processes in which these values are not set to the flags. After the initializing process is performed, the CPU 50 clears all the flags.

(5) Cover Open Time Measuring Process

In this exemplary embodiment, the opening degree of opening of the cover 2A has three levels including a level corresponding to the upper part 41A of the moving member 41 (opening level 1), a level corresponding to the middle part 41B (opening level 2), and a level corresponding to the lower part 41C (opening level 3), and the time for which the opening degree is equal to or greater than each opening level is counted.

Further, in this exemplary embodiment, for example, when the opening degree of the cover 2A is switched several times between a degree less than the opening level 3 and a degree equal to or greater than the opening level 3, the longest time for which the degree of opening is maintained at the opening level 3 or more (the longest duration) is set as the time for which the opening degree is the opening level 3 or more. This is similarly applied to the opening level 1 and the opening level 2.

Figure 7:
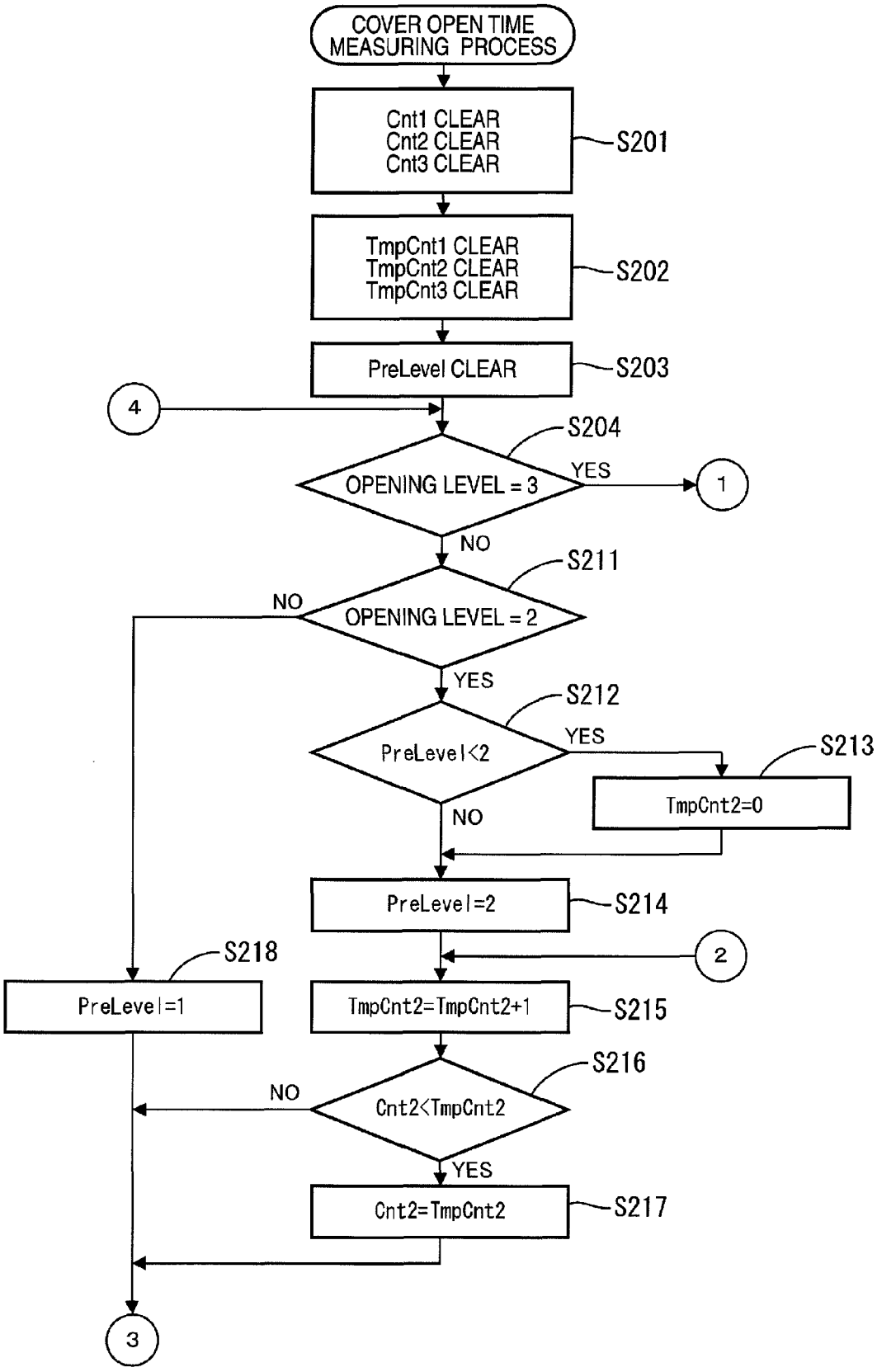
FIG. 7 is a flowchart illustrating a cover open time measuring process according to an exemplary embodiment of the present invention.
Figure 8:
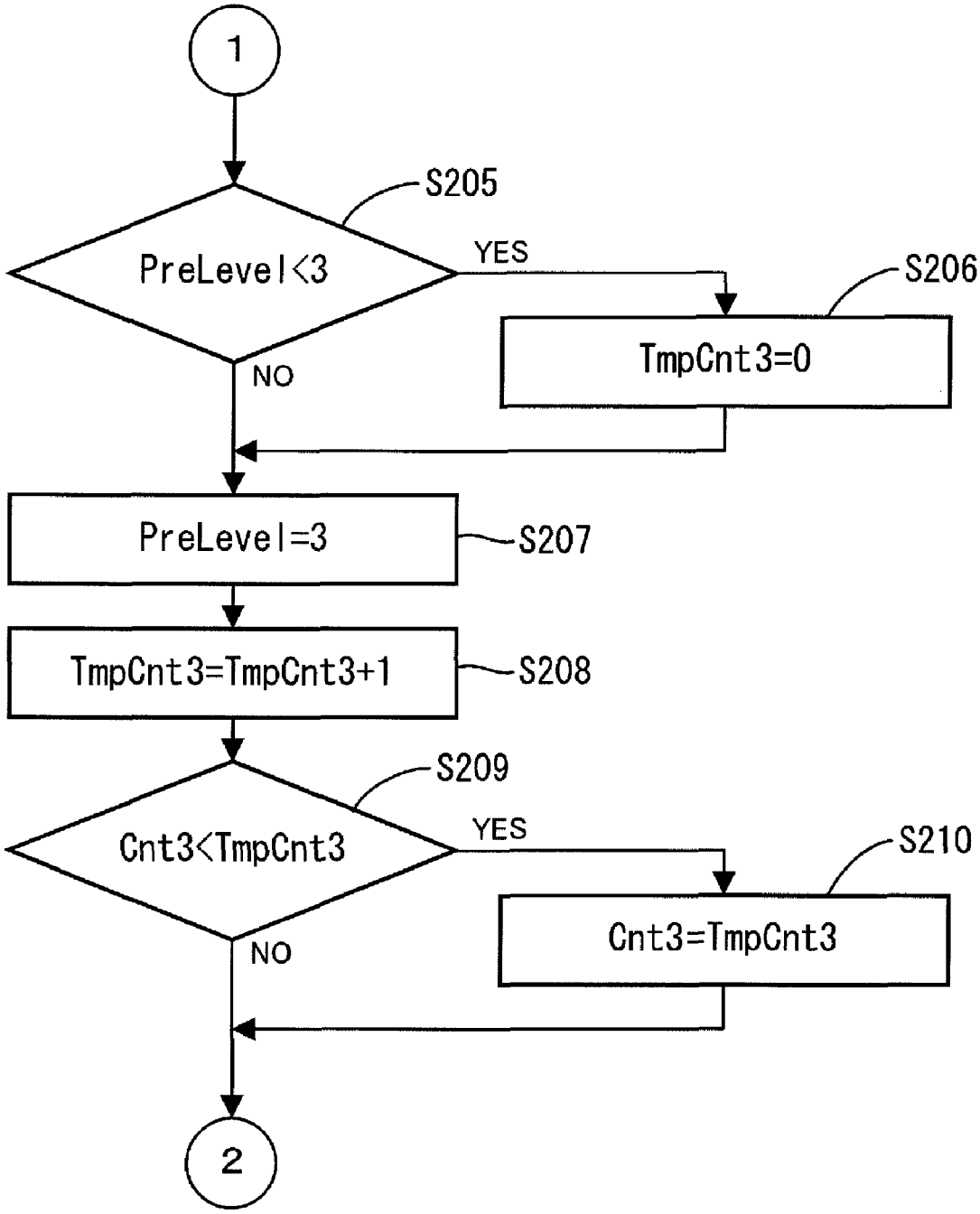
FIG. 8 is a flowchart illustrating the cover open time measuring process.
Figure 9:
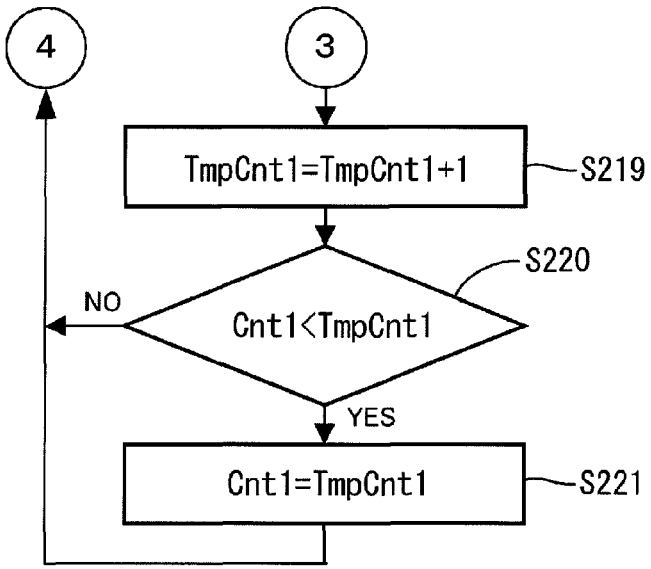
FIG. 9 is a flowchart illustrating the cover open time measuring process.

FIGS. 7 to 9 are flowcharts illustrating the cover open time measuring process. The process is an endless loop, and the CPU 50 repeatedly performs the loop at a rate of one per millisecond.

In Step S201, the CPU 50 initializes variables an "opening level 1 counter (Cnt1)", an "opening level 2 counter (Cnt2)", and an "opening level 3 counter (Cnt3)" storing the longest duration for each opening level. Zero millisecond is set to the variables by the initializing operation.

In Step S202, the CPU 50 initializes variables an "opening level 1 temporary counter (TmpCnt1)", an "opening level 2 temporary counter (TmpCnt2)", and an "opening level 3 temporary counter (TmpCnt3)" counting the time for which the opening degree is maintained at the corresponding opening level or more for each opening level. Zero millisecond is set to the variables by the initializing operation.

In Step S203, the CPU 50 initializes a variable a "previous opening level (PreLevel)" storing the previous opening level. When the variable is initialized, a value (for example, zero) which does not correspond to any opening level is set to the variable "previous opening level (PreLevel)".

In Step S204, the CPU 50 determines whether the current opening degree of the cover 2A is the opening level 3 based on the detection signal output from the cover opening degree sensor 40. Here, the opening degree means the opening degree at maximum in the open state, but is not a value before the maximum opening degree. When it is determined that the current opening level is 3, the CPU 50 proceeds to Step S205 shown in FIG. 8. On the other hand, when it is determined that the current opening level is less than 3, the CPU 50 proceeds to Step S211.

In Step S205, when the "previous opening level (PreLevel)" is 3, the CPU 50 proceeds to Step S207. When the "previous opening level (PreLevel)" is a value other than 3, the CPU 50 proceeds to Step S206.

In Step S206, the CPU 50 initializes the "opening level 3 temporary counter (TmpCnt3)". For example, the opening degree is changed from a level equal to or greater than the opening level 3 to a level less than the opening level 3, and then changed to a level equal to or greater than the opening level 3. In this case, the state in which the opening degree is equal to or greater than the opening level 3 temporarily stops. Therefore, the "opening level 3 temporary counter (TmpCnt3)" is initialized. When the variable is initialized, zero millisecond is set to the "opening level 3 temporary counter (TmpCnt3)".

In Step S207, the CPU 50 sets 3 to the "previous opening level (PreLevel)", and the CPU 50 proceeds to Step S208. In Step S208, the CPU 50 sets 1 millisecond to the "opening level 3 temporary counter (TmpCnt3)". In Step S209, the CPU 50 determines whether the value of the "opening level 3 temporary counter (TmpCnt3)" is greater than that of the "opening level 3 counter (Cnt3)". If it is determined that the value of the "opening level 3 temporary counter (TmpCnt3)" is greater than that of the "opening level 3 counter (Cnt3)", the CPU 50 proceeds to Step S210. On the other hand, if it is determined that the value of the "opening level 3 temporary counter (TmpCnt3)" is equal to or less than that of the "opening level 3 counter (Cnt3)", the CPU 50 proceeds to Step S215.

In Step S210, the CPU 50 sets the value of the "opening level 3 temporary counter (TmpCnt3)" to the "opening level 3 counter (Cnt3)". In this way, the longest duration of the opening level 3 is updated.

In Step S211, when the current opening degree of the cover 2A is the opening level 2, the CPU 50 proceeds to Step S212. On the other hand, when the current opening degree of the cover 2A is less than the opening level 2, the CPU 50 proceeds to Step S218.

In Step S212, the CPU 50 determines whether the "previous opening level (PreLevel)" is 2. When the "previous opening level (PreLevel)" is 2, the CPU 50 proceeds to Step S213. On the other hand, when the "previous opening level (PreLevel)" is other than 2, the CPU 50 proceeds to Step S214. In Step S213, the CPU 50 initializes the "opening level 2 temporary counter (TmpCnt2)". When the "opening level 2 temporary counter (TmpCnt2)" is initialized, zero millisecond is set to the "opening level 2 temporary counter (TmpCnt2)".

In Step S214, the CPU 50 sets 2 to the "previous opening level (PreLevel)", and thereafter, in Step S215, the CPU 50 adds 1 millisecond to the "opening level 2 temporary counter (TmpCnt2)". Then, the CPU 50 proceeds to Step S216.

In Step S216, the CPU 50 determines whether the value of the "opening level 2 temporary counter (TmpCnt2)" is greater than that of the "opening level 2 counter (Cnt2)". If it is determined that the value of the "opening level 2 temporary counter (TmpCnt2)" is greater than that of the "opening level 2 counter (Cnt2)", the CPU 50 proceeds to Step S217. If it is determined that the value of the "opening level 2 temporary counter (TmpCnt2)" is equal to or less than that of the "opening level 2 counter (Cnt2)", the CPU 50 proceeds to Step S219 shown in FIG. 9.

In Step S217, the CPU 50 sets the value of the "opening level 2 temporary counter (TmpCnt2)" to the "opening level 2 counter (Cnt2)". In this way, the longest duration of the opening level 2 is updated.

In Step S218, the CPU 50 sets 1 to the "previous opening level (PreLevel)". Thereafter, in Step S219, the CPU 50 adds 1 millisecond to the "opening level 1 temporary counter (TmpCnt1)", and proceeds to Step S220.

In Step S220, the CPU 50 determines whether the value of the "opening level 1 temporary counter (TmpCnt1)" is greater than that of the "opening level 1 counter (Cnt1)". If it is determined that the value of the "opening level 1 temporary counter (TmpCnt1)" is greater than that of the "opening level 1 counter (Cnt1)", the CPU 50 proceeds to Step S221. If it is determined that the value of the "opening level 1 temporary counter (TmpCnt1)" is equal to or less than that of the "opening level 1 counter (Cnt1)", the CPU 50 returns to Step S204 shown in FIG. 7.

In Step S221, the CPU 50 sets the value of the "opening level 1 temporary counter (TmpCnt1)" to the "opening level 1 counter (Cnt1)".

(6) Determination Whether to Perform Each Initializing Process

Next, a process of determining whether to perform each initializing process will be described. In the following description, it is assumed that the flags used in each process are cleared, for example, when power is turned on, except for the "belt jam flag".

(6-1) Belt Jam Removal Determining Process

Figure 10:
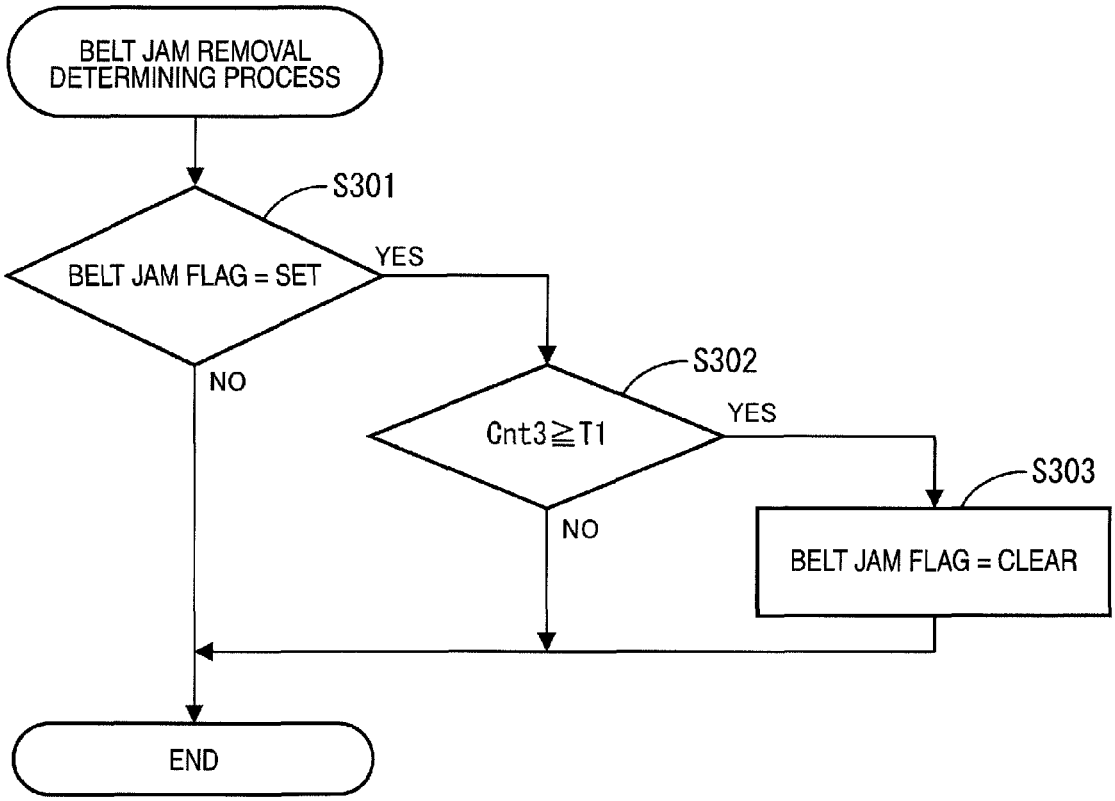
FIG. 10 is a flowchart illustrating a belt jam removal determining process according to an exemplary embodiment of the present invention.

FIG. 10 is a flowchart illustrating the belt jam removal determining process. In Step S301, the CPU 50 determines whether the "belt jam flag" is set. If it is determined that the "belt jam flag" is set, the CPU 50 proceeds to Step S302. If it is determined that the "belt jam flag" is not set, the CPU 50 ends the process.

In Step S302, the CPU 50 determines whether the "opening level 3 counter (Cnt3)" is T1 seconds or more. For example, T1 seconds are 3 seconds. If it is determined that the "opening level 3 counter (Cnt3)" is T1 seconds or more, the CPU 50 proceeds to Step S303. If it is determined that the "opening level 3 counter (Cnt3)" is less than T1 seconds, the CPU 50 ends the process.

In Step S303, the CPU 50 determines that the belt jam is more likely to be removed and clears the "belt jam flag".

(6-2) Transport Belt Cleaning Determining Process

Figure 11:
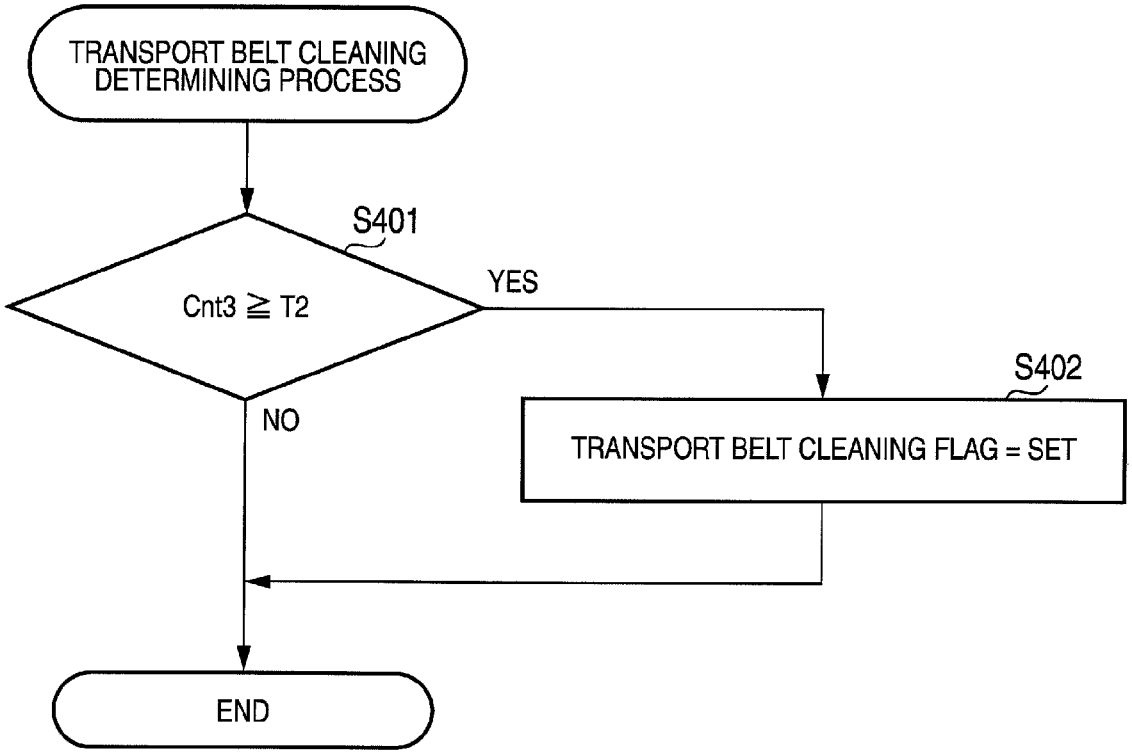
FIG. 11 is a flowchart illustrating a transport belt cleaning determining process according to an exemplary embodiment of the present invention.

FIG. 11 is a flowchart illustrating the transport belt cleaning determining process. In Step S401, the CPU 50 determines whether the "opening level 3 counter (Cnt3)" is T2 seconds or more. For example, T2 seconds are 2 seconds. If it is determined that the "opening level 3 counter (Cnt3)" is T2 seconds or more, the CPU 50 proceeds to Step S402. If it is determined that the "opening level 3 counter (Cnt3)" is less than T2 seconds, the CPU 50 ends the process.

In Step S402, the CPU 50 determines that, for example, dust is likely to be adhered to the transport belt 13, and sets a value indicating execution to a variable "transport belt cleaning flag" indicating whether to perform the transport belt cleaning process.

(6-3) Developing Cartridge Insertion/Removal Determining Process

Figure 12:
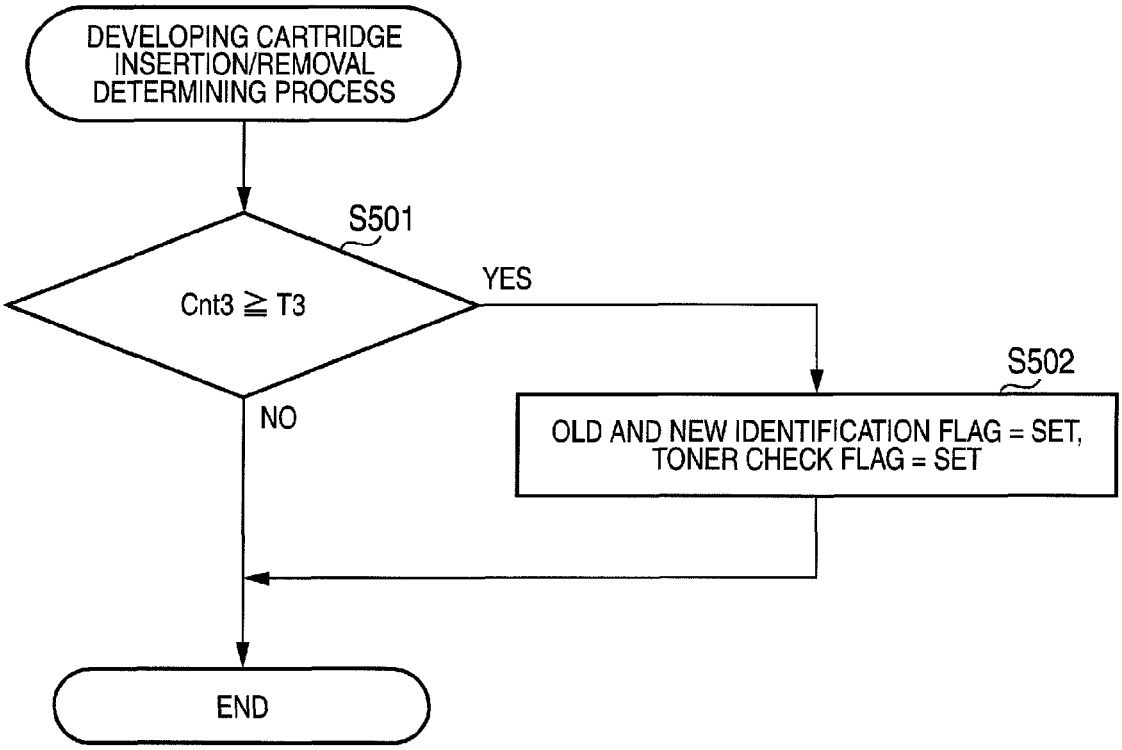
FIG. 12 is a flowchart illustrating a developing cartridge insertion/removal determining process according to an exemplary embodiment of the present invention.

FIG. 12 is a flowchart illustrating the developing cartridge insertion/removal determining process. In Step S501, the CPU 50 determines whether the "opening level 3 counter (Cnt3)" is T3 seconds or more. For example, T3 seconds are 2 seconds. If it is determined that the "opening level 3 counter (Cnt3)" is T3 seconds or more, the CPU 50 proceeds to Step S502. If it is determined that the "opening level 3 counter (Cnt3)" is less than T3 seconds, the CPU 50 ends the process.

In Step S502, the CPU 50 determines that the developing cartridge 22 is likely to be inserted or removed, and sets a value indicating execution to a variable "old and new identification flag" indicating whether to perform the old and new developing cartridge identifying process and a variable "toner check flag" indicating whether to perform the remaining toner amount detecting process.

(6-4) Photosensitive Drum Counter Clear Determining Process

Figure 13:
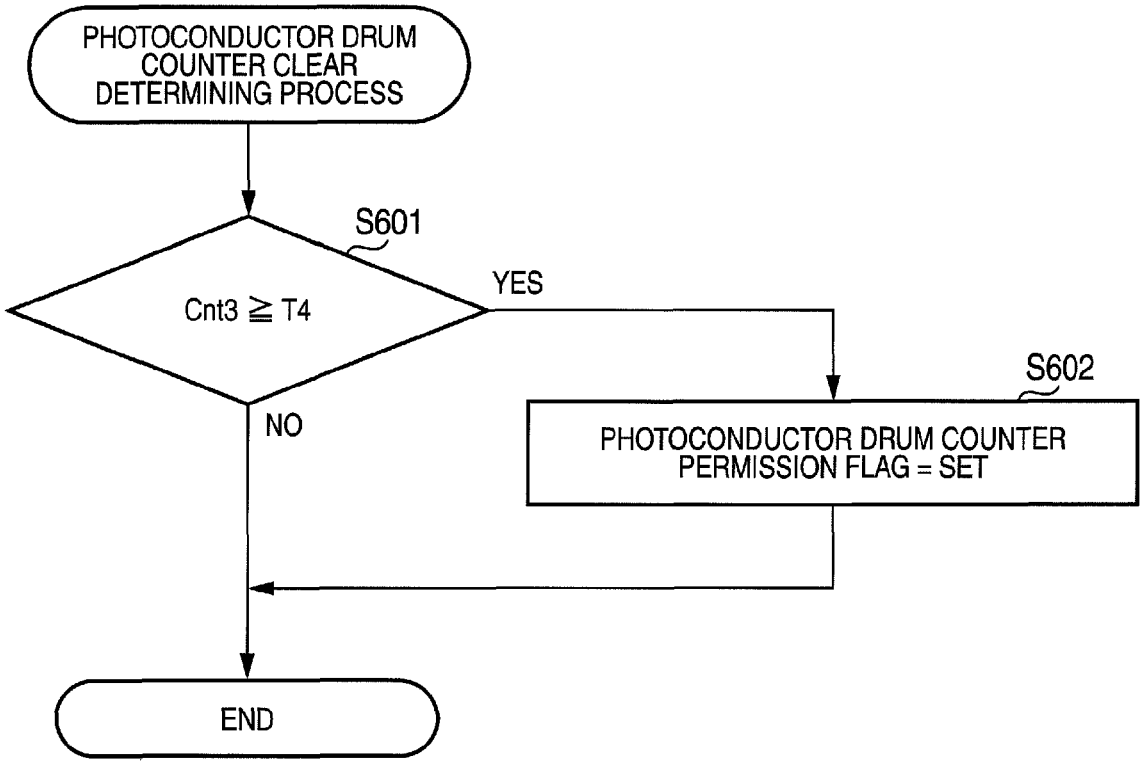
FIG. 13 is a flowchart illustrating a photosensitive drum counter clear determining process according to an exemplary embodiment of the present invention.

FIG. 13 is a flowchart illustrating the photosensitive drum counter clear determining process. In Step S601, the CPU 50 determines whether the "opening level 3 counter (Cnt3)" is T4 seconds or more. For example, T4 seconds are 2 seconds. If it is determined that the "opening level 3 counter (Cnt3)" is T4 seconds or more, the CPU 50 proceeds to Step S602. If it is determined that the "opening level 3 counter (Cnt3)" is less than T4 seconds, the CPU 50 ends the process.

In Step S602, the CPU 50 determines that a replacement notice is less likely to be issued by an erroneous operation, and sets a value indicating permission to a variable "photosensitive drum counter clear permission flag" indicating whether to permit the photosensitive drum counter clear process.

(6-5) Transport Belt Counter Clear Determining Process

Figure 14:
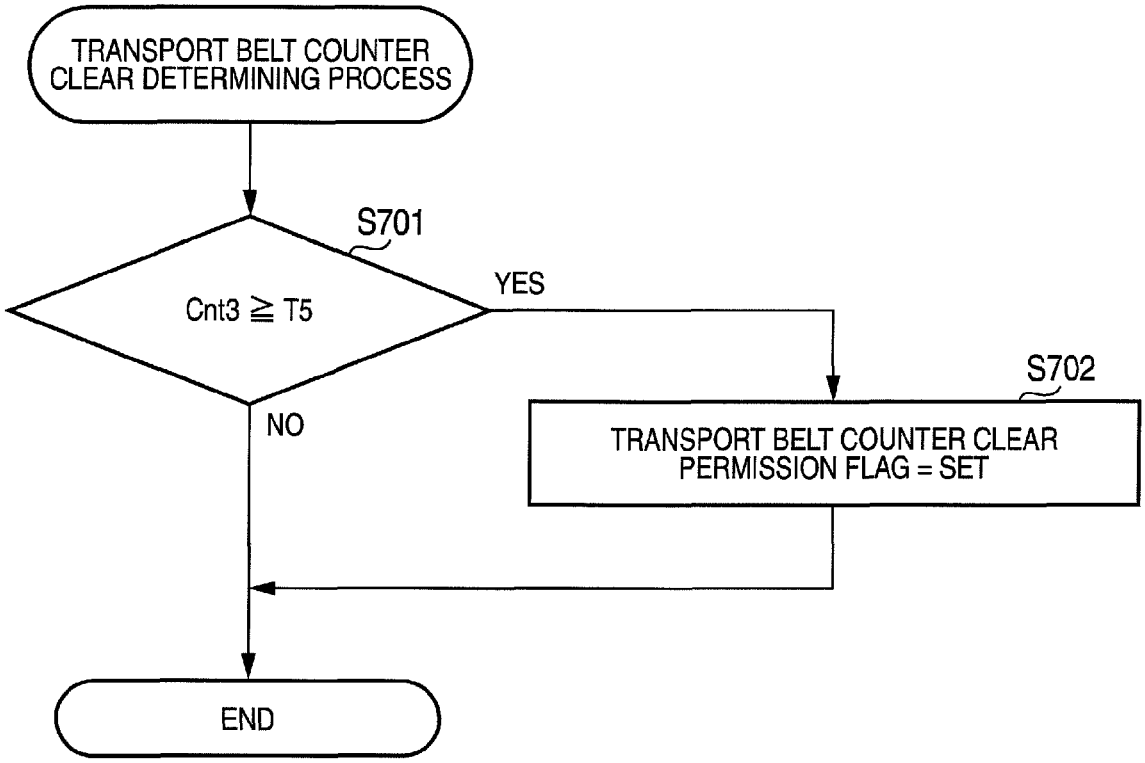
FIG. 14 is a flowchart illustrating a transport belt counter clear determining process according to an exemplary embodiment of the present invention.

FIG. 14 is a flowchart illustrating the transport belt counter clear determining process. In Step S701, the CPU 50 determines whether the "opening level 3 counter (Cnt3)" is T5 seconds or more. For example, T5 seconds are 10 seconds. If it is determined that the "opening level 3 counter (Cnt3)" is T5 seconds or more, the CPU 50 proceeds to Step S701. If it is determined that the "opening level 3 counter (Cnt3)" is less than T5 seconds, the CPU 50 ends the process.

In Step S702, the CPU 50 determines that a replacement notice is less likely to be issued by an erroneous operation, and sets a value indicating permission to a variable "transport belt counter clear permission flag" indicating whether to permit the transport belt counter clear process.

(6-6) Rotating Shaft Pre-Rotating Request Determining Process

Figure 15:
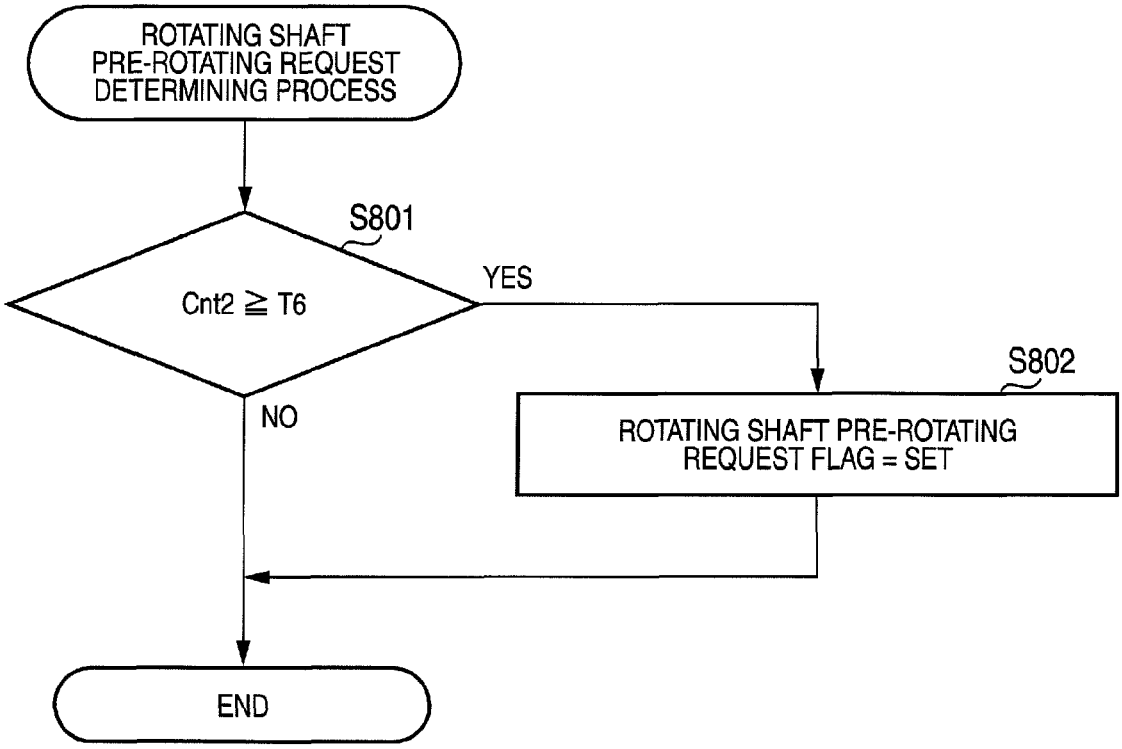
FIG. 15 is a flowchart illustrating a rotating shaft prerotating request determining process according an exemplary embodiment of the present invention.

FIG. 15 is a flowchart illustrating the rotating shaft pre-rotating request determining process. Here, it is assumed that, when the opening level of the cover 2A is 2, the rotating shaft is retreated. In Step S801, the CPU 50 determines whether the "opening level 2 counter (Cnt2)" is T6 seconds or more. For example, T6 second is one second. If it is determined that the "opening level 2 counter (Cnt2)" is T6 seconds or more, the CPU 50 proceeds to Step S802. If it is determined that the "opening level 2 counter (Cnt2)" is less than T6 seconds, the CPU 50 ends the process.

In Step S802, the CPU 50 determines that the photosensitive drum 28 is likely to be inserted or removed, or it is likely to be rotated, and sets a value indicating request to a variable "rotating shaft pre-rotating request flag" indicating whether to request the rotation of the rotating shaft before the transport belt 13 is rotated.

(6-7) Color Shift Correction Request Determining Process

Figure 16:
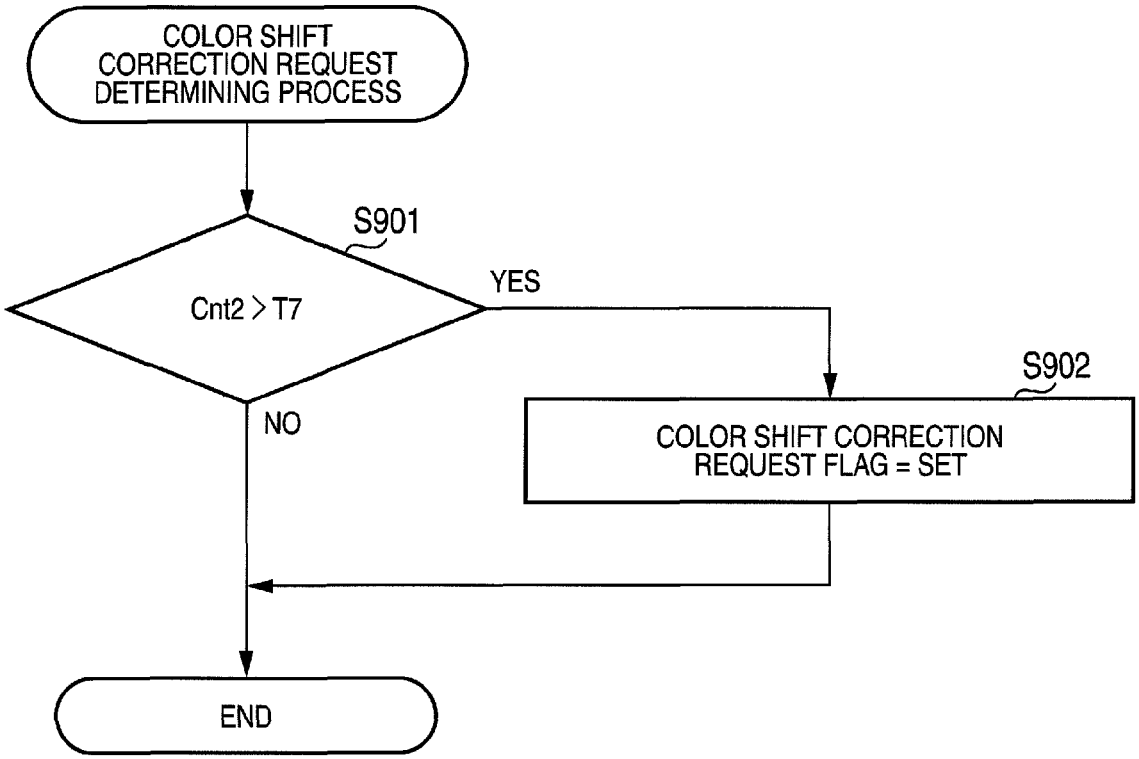
FIG. 16 is a flowchart illustrating a color shift correction request determining process according to an exemplary embodiment of the present invention.

FIG. 16 is a flowchart illustrating the color shift correction request determining process. In Step S901, the CPU 50 determines whether the "opening level 2 counter (Cnt2)" is more than T7 seconds. For example, T7 second is 0 second. The reason why T7 second is 0 second is that the positional deviation of the LED unit 18 depends on only the degree of opening, regardless of the cover open time period, and when the degree of opening is instantaneously equal to or greater than the opening level 2, the positional deviation is likely to occur. If it is determined that the "opening level 2 counter (Cnt2)" is more than T7 seconds, the CPU 50 proceeds to Step S902. If it is determined that the "opening level 2 counter (Cnt2)" is equal to or less than T7 seconds, the CPU 50 ends the process.

In Step S902, the CPU 50 determines that a color shift is likely to occur, and sets a value indicating request to a variable "color shift correction request flag" indicating whether to request the color shift correcting process.

(7) Effects of this Exemplary Embodiment

According to the printer 1 of the above-described exemplary embodiment of the present invention, for example, when the opening level of the cover 2A in an open state is equal to or greater than 3, the old and new developing cartridge identifying process is performed. When the opening level is less than 3, the old and new developing cartridge identifying process is not performed. When the opening level of the cover 2A in the open state is less than 3, there is a high probability that the developing cartridge 22 is not replaced. Therefore, in this state, when the old and new developing cartridge identifying process is performed, the process is likely to be not useful.

As such, according to the printer 1, the initializing process is controlled according to the opening degree of the cover 2A in the open state. Specifically, when the opening degree of the cover 2A in the open state is equal to or greater than a threshold value, the initializing process is performed. When the opening degree is less than the threshold value, the performing of the initializing process is restricted (not done). Therefore, it is possible to reduce or prevent performing useless initializing process.

Further, according to the printer 1, it is determined whether the opening degree of the cover 2A at maximum is equal to or greater than a threshold value. Therefore, it is possible to more appropriately determine whether to perform the initializing process.

Furthermore, according to the printer 1, even though the opening degree of the cover 2A is equal to or greater than a threshold value, the performing of the initializing process is restricted if the cover open time period is shorter than a threshold time. Therefore, it is possible to reduce or prevent performing useless initializing process.

According to the printer 1, the time for which the opening degree of the cover 2A is equal to or greater than a threshold value is set as the cover open time period. Therefore, it is possible to reduce or prevent performing useless initializing process.

In some cases, the opening degree of the cover is switched between a degree less than the threshold value and a degree equal to or greater than the threshold value. Even though the sum of the times for which the opening degree is equal to or greater than the threshold value is equal to or greater than a threshold time, a maintenance operation is not likely to be performed if the duration of each opening operation is less than the threshold time. In this case, when the initializing process is performed, the initializing process is likely to be not useful. According to the printer 1, the longest time period (duration) for which the opening degree of the cover 2A is equal to or greater than a threshold value in the open state is set as the cover open time period. Therefore, it is possible to reduce or prevent performing useless initializing process.

Furthermore, according to the printer 1, when a belt jam occurs and the opening degree of the cover 2A in the open state is less than the opening level 3, it is determined that the jam is not removed, and the performing of the initializing process is restricted. Therefore, it is possible to reduce or prevent the belt jam from becoming worse.

Other Exemplary Embodiments

While the present invention has been shown and described with reference to certain exemplary embodiments thereof, it will be understood by those skilled in the art that various changes in form and details may be made therein without departing from the spirit and scope of the invention as defined by the appended claims.

(1) In the above-described exemplary embodiment, it is determined whether to perform the initializing process based on the opening degree of the cover 2A. However, it may be determined whether to perform the initializing process based on the opening degree of the cover 2B or the cover 2C. However, the cover 2B and the cover 2C are mainly used to remove a jam, but are not used to replace the developing cartridge 22 or the photosensitive drum 28. That is, the initializing process performed when the cover is closed depends on the use of the cover.

(2) In the above-described exemplary embodiment, the cover opening degree sensor 40 detects the opening degree at three levels. For example, when a "threshold value" is set to 1, the cover opening degree sensor 40 may detect the opening degree at two levels. When the threshold value is set to a very small value, the opening degree of may not be divided into levels.

In the above-described exemplary embodiment, the moving member 41 which is movable in the vertical direction is used to detect the opening degree. For example, the cover opening degree sensor 40 may detect the rotation angle of the cover 2A to detect the opening degree as long as it can detect the opening degree of the cover.

(3) In the above-described exemplary embodiment, the cover open/close sensor 36 is used to detect a state change of the cover 2A from an open state to a closed state. However, the sensor output of the cover opening degree sensor 40 may be used to detect the state change.

(4) In the above-described exemplary embodiment, one "old and new identification flag" is set to four color developing cartridges 22. However, the opening degree of the cover 2A required for inserting or removing the developing cartridge 22 depends on the position of the developing cartridge 22. Therefore, different opening levels may be set to the developing cartridges 22, and individual "old and new identification flags" may be set to the developing cartridges to individually determine whether to perform the old and new developing cartridge identifying process. This may be similarly applied to the "toner check flag".

(5) In the above-described exemplary embodiment, the "opening level 1 counter (Cnt1)" is not used to determine whether to perform the initializing process. However, when a maintenance operation is considered even when the opening level is 1, the "opening level 1 counter (Cnt1)" may be used to determine whether to perform an initializing process corresponding to the maintenance operation.

(6) In the above-described exemplary embodiment, a color printer is used as an example of the image forming apparatus. However, the present invention may be applied to a monochrome printer which uses one color toner to form a monochrome image. Further, in the above-described exemplary embodiment, a laser printer is used as an example of the image forming apparatus. However, the present invention may be applied to an ink jet printer.

(7) In the above-described exemplary embodiment, the cover 2A is provided rotatably to open and close the opening 30. However, the present invention may be applied to a cover which is slidable with respect to the casing 2 to open and close an opening formed in the casing 2.

(8) In the above-described exemplary embodiment, the sheet feed tray 4 is also configured to open and close an opening provided to the casing 2. The initializing process may be controlled according to the opening degree of the sheet feed tray 4.

(9) In the above-described exemplary embodiment, the open time period during which the opening degree of the cover 2A is equal to or greater than the threshold value is used to determine whether to perform initializing process. However, an open time period during which the cover 2A is in the open state irrespective of the opening degree may be used to determine whether to perform initializing process if the opening degree of the cover 2A becomes equal to or greater than the threshold value at least one time within the open time period during which the cover 2A is in the open state.

What is claimed is:

1. An image forming apparatus comprising:

a casing formed with an opening and including a cover configured to open and close the opening;

an image forming unit configured to perform printing on a recording medium and an initializing process, wherein the image forming unit comprises:

a belt configured to transport the recording medium;

a cleaning unit configured to clean the belt, and wherein the initializing process comprises a cleaning of the belt by the cleaning unit;

a detecting unit configured to detect whether the cover is in an open state or a closed state;

a measuring unit configured to measure an opening degree of the cover; and a controller coupled to the detecting unit and the measuring unit, wherein, when the detecting unit detects that the state of the cover is changed from the closed state to the open state and returned to the closed state, the controller controls the image forming unit, based on the opening degree of the cover within a first open time period during which the detecting unit detects that the cover is in the open state, to perform the initializing process upon the detecting unit detecting the cover returned to the closed state, if the opening degree of the cover is equal to or greater than a threshold value within the first open time period, and not to perform the initializing process upon the detecting unit detecting the cover returned to the closed state, if the opening degree of the cover is less than the threshold value within the first open time period.

2. The image forming apparatus according to claim 1, further comprising a timer configured to measure the first open time period during which the detecting unit detects that the cover is in the open state, wherein the controller is coupled to the timer, wherein the controller controls the image forming unit, based on the first open time period measured by the timer and the opening degree of the cover measured by the measuring unit within the first open time period, to perform the initializing process upon the detecting unit detecting the cover returned to the closed state, if the opening degree of the cover becomes equal to or greater than the threshold value at least one time within the first open time period and if the first open time period is equal to or greater than a threshold time period, and not to perform the initializing process upon the detecting unit detecting the cover returned to the closed state, if the opening degree of the cover does not become equal to or greater than the threshold value within the first time open time period or if the first open time period is less than the threshold time period.

3. The image forming apparatus according to claim 1, further comprising a timer configured to measure a second open time period during which the detecting unit detects that the cover is opened by an amount equal to or greater than the threshold value within the first open time period, wherein the controller controls the image forming unit, based on the second open time period measured by the timer, to perform the initializing process upon the detecting unit detecting the cover returned to the closed state, if the second open time period is equal to or greater than a threshold time period, and not to perform the initializing process upon the detecting unit detecting the cover returned to the closed state, if the second open time period is less than the threshold time period.

4. The image forming apparatus according to claim 3, wherein if the timer measures the second open time period during which the cover is opened by greater than the threshold value, by a plurality of times within the first open time period, the controller uses a longest second open time period to control the image forming unit.

5. The image forming apparatus according to claim 1, further comprising:

a transporting unit configured to transport the recording medium along a transport path; and a plurality of sensors provided along the transport path and configured to detect the recording medium transported by the transport unit, wherein the controller is coupled to the plurality of sensors, and wherein while adjacent sensors detect the recording medium, when the detecting unit detects that the state of the cover is changed from the closed state to the open state and returned to the closed state, the controller controls the image forming unit, based on the opening degree of the cover within the first opening time period during which the detecting unit detects that the cover is in the open state, to perform the initializing process upon the detecting unit detecting the cover returned to the closed state, if the opening degree of the cover is equal to or greater than the threshold value within the first open time period, and not to perform the initializing process upon the detecting unit detecting the cover returned to the closed state, if the opening degree of the cover is less than the threshold value within the first open time period.

6. The image forming apparatus according to claim 1, wherein the measuring unit includes:

a moving member provided movably in a movement direction in association with the opening and closing of the cover and having a surface with different reflectances in the movement direction;

a light source configured to emit light to the surface of the moving member; and an optical sensor configured to receive light reflected from the surface and output a detection signal corresponding to an intensity of the received light, and wherein the opening degree of the cover is measured based on the detection signal output from the optical sensor.

7. An image forming apparatus comprising:

a casing including a door;

an image forming unit operable in a first mode and a second mode, wherein the image forming unit comprises:

a belt configured to convey a recording medium;

a cleaning unit configured to clean the belt, and wherein in the first mode, the image forming unit prints an image on the recording medium, and in the second mode, the cleaning unit cleans the belt;

a detecting unit configured to detect a state of the door from among a closed state in which the door is closed, a first open state in which the door is opened and an opening degree of the door is less than a threshold value, and a second open state in which the door is opened and the opening degree of the door is equal to or greater than the threshold value; and a controller coupled to the image forming unit and the detecting unit, wherein the controller controls the image forming unit, if the state of the door is changed from the closed state to the first opened state and returned to the closed state without being in the second opened state, to operate in the first mode upon the door returned to the closed state, and if the state of the door is changed from the closed state to the second open state through the first open state, and thereafter, returned to the closed state through the first open state, to operate in the second mode upon the door returned to the closed state, and thereafter, switch to the first mode.

8. The image forming apparatus according to claim 7, wherein, in the first mode, the image forming unit prints an image on the recording medium, and in the second mode, the image forming unit performs an initializing process.

9. An image forming apparatus comprising:

an image forming unit configured to form an image on a recording medium;

a casing formed with an opening and accommodating the image forming unit;

a cover configured to open and close the opening;

a detecting unit configured to detect a state change of the cover between an open state and a closed state;

a measuring unit configured to measure an opening degree of the cover in the opened state; and a controller configured to control the measuring unit to measure the opening degree of the cover when the detecting unit detects that the state of the cover is the open state;

start a first initializing process after the detecting unit detects the state of the cover changes from the open state to the closed state, if the opening degree measured when the cover is in the open state is greater than or equal to a predetermined value; and start a second initializing process after the detecting unit detects the state of the cover changes from the open state to the closed state, if the opening degree measured while the cover is in the open state is less than the predetermined value.

* * * * *